US010564574B2

(12) United States Patent
Nakajima et al.

(10) Patent No.: US 10,564,574 B2
(45) Date of Patent: Feb. 18, 2020

(54) DEVELOPER SUPPLY CONTAINER

(71) Applicant: CANON KABUSHIKI KAISHA, Tokyo (JP)

(72) Inventors: Nobuo Nakajima, Higashimatsuyama (JP); Ayatomo Okino, Moriya (JP); Katsuya Murakami, Toride (JP); Toshiaki Nagashima, Moriya (JP); Yutaka Ban, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/136,899

(22) Filed: Sep. 20, 2018

(65) Prior Publication Data

US 2019/0018347 A1 Jan. 17, 2019

Related U.S. Application Data

(60) Division of application No. 15/583,374, filed on May 1, 2017, now abandoned, which is a division of (Continued)

(30) Foreign Application Priority Data

Nov. 24, 2004 (JP) ..... 2004-339391

(51) Int. Cl.
*G03G 15/08* (2006.01)
*G03G 15/09* (2006.01)
*G03G 21/16* (2006.01)

(52) U.S. Cl.
CPC ..... *G03G 15/0935* (2013.01); *G03G 15/0808* (2013.01); *G03G 15/0865* (2013.01); (Continued)

(58) Field of Classification Search
CPC ..... G03G 15/0872; G03G 15/0877; G03G 15/0808; G03G 15/0865; G03G 15/0886; (Continued)

(56) References Cited

U.S. PATENT DOCUMENTS 5,331,382 A 7/1994 Miura
5,572,301 A 11/1996 Shiratori
(Continued)

FOREIGN PATENT DOCUMENTS

EP 0 668 546 A2 8/1995
EP 0 682 297 A2 11/1995
(Continued)

OTHER PUBLICATIONS

European Search Report dated Jun. 8, 2009, in European Application No. 05811479.4-1240/1818729.
(Continued)

*Primary Examiner* — Sophia S Chen
(74) *Attorney, Agent, or Firm* — Venable LLP

(57) ABSTRACT

If a user is not familiar with the operation for the developer supply container, the rotating operation for the developer supply container may be insufficient, so that developer supply container does not reach a predetermined operating position, with the result of abnormal developer supply. by increasing a rotation load of a second gear 6 which is in an operable connection with a drive gear member 12 of the developer receiving apparatus 10 by a function of a locking member 7, the developer supply container 1 mounted to the developer receiving apparatus 10 is rotated toward the supply position. After the developer supply container 1 rotates to the supply position, the locking by the locking member 7 is released, by which the rotation load applied to the second gear 6 is reduced, so that drive transmission, thereafter, to the feeding member 4 for developer supply is smooth.

1 Claim, 31 Drawing Sheets

Related U.S. Application Data application No. 14/976,057, filed on Dec. 21, 2015, now abandoned, which is a division of application No. 14/147,872, filed on Jan. 6, 2014, now abandoned, which is a division of application No. 13/349,998, filed on Jan. 13, 2012, now Pat. No. 8,649,711, which is a division of application No. 13/091,558, filed on Apr. 21, 2011, now Pat. No. 8,131,189, which is a division of application No. 12/836,724, filed on Jul. 15, 2010, now Pat. No. 7,957,679, which is a division of application No. 12/189,273, filed on Aug. 11, 2008, now Pat. No. 7,796,923, which is a division of application No. 11/750,603, filed on May 18, 2007, now Pat. No. 7,412,192, which is a continuation of application No. PCT/JP2005/022030, filed on Nov. 24, 2005.

(52) U.S. Cl.
CPC ..... *G03G 15/0872* (2013.01); *G03G 15/0877* (2013.01); *G03G 15/0886* (2013.01); *G03G 15/0889* (2013.01); *G03G 21/1676* (2013.01); *G03G 2215/067* (2013.01); *G03G 2215/0663* (2013.01); *G03G 2215/085* (2013.01)

(58) Field of Classification Search
CPC ..... G03G 15/0889; G03G 15/0935; G03G 21/1676; G03G 2215/0663; G03G 2215/067; G03G 2215/085
See application file for complete search history.

(56) References Cited

U.S. PATENT DOCUMENTS

| | | | |
|---|---|---|---|
| 5,579,101 | A | 11/1996 | Omata et al. |
| 5,860,048 | A | 1/1999 | Bonanno |
| 5,907,756 | A | 5/1999 | Shirota et al. |
| 5,970,293 | A | 10/1999 | Huang |
| 6,185,401 | B1 | 2/2001 | Kanamori et al. |
| 6,334,035 | B1 | 12/2001 | Abe et al. |
| 6,363,232 | B1 | 3/2002 | Flaherty |
| 6,438,345 | B1 | 8/2002 | Ban et al. |
| 6,542,709 | B1 | 4/2003 | Wang et al. |
| 6,560,422 | B2 | 5/2003 | Kanno et al. |
| 6,766,133 | B1 | 7/2004 | Ban et al. |
| 6,839,533 | B2 | 1/2005 | Ban et al. |
| 6,934,494 | B2 | 8/2005 | Yamada et al. |
| 7,062,205 | B2 | 6/2006 | Nagashiro |
| 7,203,449 | B2 | 4/2007 | Ban et al. |
| 7,266,330 | B2 | 9/2007 | Murakami et al. |
| 7,292,811 | B2 | 11/2007 | Ban et al. |
| 7,302,213 | B2 * | 11/2007 | Kimura ..... G03G 15/0867 399/262 |
| 7,325,385 | B2 | 2/2008 | Nagashima et al. |
| 7,369,798 | B2 | 5/2008 | Sasae et al. |
| 7,430,390 | B2 | 9/2008 | Ban et al. |
| 7,577,385 | B2 | 8/2009 | Ban et al. |
| 2002/0154916 | A1 | 10/2002 | Campbell et al. |
| 2003/0081968 | A1 | 5/2003 | Minagawa |
| 2003/0223782 | A1 | 12/2003 | Ban et al. |
| 2004/0047651 | A1 | 3/2004 | Koyama et al. |
| 2004/0052553 | A1 | 3/2004 | Isomura et al. |
| 2004/0161266 | A1 | 8/2004 | Ban et al. |
| 2004/0223790 | A1 | 11/2004 | Hosokawa et al. |
| 2005/0135842 | A1 | 6/2005 | Murakami et al. |
| 2005/0169672 | A1 | 8/2005 | Ban et al. |
| 2006/0083553 | A1 | 4/2006 | Makino |
| 2007/0231016 | A1 | 10/2007 | Ban et al. |
| 2008/0260422 | A1 | 10/2008 | Sasae et al. |
| 2008/0273895 | A1 | 11/2008 | Ban et al. |
| 2008/0304870 | A1 | 12/2008 | Nakajima et al. |
| 2008/0304872 | A1 | 12/2008 | Nakajima et al. |
| 2009/0129813 | A1 | 5/2009 | Nagashima et al. |
| 2009/0297226 | A1 | 12/2009 | Nagashima et al. |
| 2010/0278564 | A1 | 11/2010 | Nagashima et al. |

FOREIGN PATENT DOCUMENTS

| | | | |
|---|---|---|---|
| EP | 0 905 577 | A2 | 3/1999 |
| EP | 1 306 730 | A2 | 5/2003 |
| EP | 1 437 632 | A1 | 7/2004 |
| EP | 1 528 439 | A1 | 5/2005 |
| JP | 53-46040 | A | 4/1978 |
| JP | 7-199620 | A | 8/1995 |
| JP | 7-199623 | A | 8/1995 |
| JP | 8-30172 | A | 2/1996 |
| JP | 8-248756 | A | 9/1996 |
| JP | 11-184242 | A | 7/1999 |
| JP | 11-194600 | A | 7/1999 |
| JP | 2001-034055 | A | 2/2001 |
| JP | 2001-242692 | A | 9/2001 |
| JP | 2003-50501 | A | 2/2003 |
| JP | 2004-054280 | A | 2/2004 |
| JP | 2004-317549 | A | 11/2004 |
| JP | 2006-178438 | A | 7/2006 |
| KR | 1999-007140 | A | 1/1999 |
| KR | 10-0282827 | B1 | 12/2000 |
| KR | 10-2001-0020691 | A | 3/2001 |
| KR | 10-0374277 | B1 | 2/2003 |
| KR | 10-2004-0021508 | A | 3/2004 |

OTHER PUBLICATIONS

Russian Official Action dated Nov. 18, 2009, in Russian Application No. 2008144940/28(058668).
Russian Official Action dated Nov. 18, 2009, in Russian Application No. 2008144950/28(058685).
Russian Official Action dated Dec. 7, 2009, in Russian Application No. 2008144949/28(058684).
Decision on Grant—Patent for Invention dated Jun. 16, 2010, in counterpart Russian Application No. 2008144950/28 (058685).
Decision on Grant—Patent for Invention, dated Oct. 18, 2010, in counterpart Russian Application No. 2008144949/28(058684).
Communication dated Dec. 22, 2010, forwarding a European Search Report dated Dec. 16, 2010, in counterpart European Application No. 10160304.1-1240/2209050.
Communication dated Dec. 30, 2010, forwarding a European Search Report dated Dec. 16, 2010, in counterpart European Application No. 10160302.5-1240/2211238.
Notice of Allowance dated Mar. 22, 2012, in Korean Application No. 10-2010-7026794.
Notice of Allowance dated Mar. 22, 2012, in Korean Application No. 10-2010-7026795.
Korean Office Action dated Nov. 27, 2012, in Korean Application No. 10-2010-7026793.
Korean Office Action dated Dec. 12, 2012, in Korean Application No. 10-2007-7014163.
Korean Office Action dated Dec. 13, 2012, in Korean Application No. 10-2010-7026792.
Korean Notice of Allowance dated Nov. 27, 2012, in Korean Application No. 10-2012-7024881.
Russian Notice of Allowance dated Jan. 29, 2014, in counterpart Russian Application No. 2011103397/28(004684).
European Search Report dated Jun. 1, 2016, in related European Patent Application No. 11165463.8.
Russian Notice of Allowance dated Jul. 12, 2016, in related Russian Patent Application No. 2014115462/12 (with English translation.
Indian Office Action dated Jul. 12, 2017, in related Indian Patent Application No. 3276/CHENP/2011.
Indian Office Action dated Sep. 26, 2017, in related Indian Patent Application No. 3277/CHENP/2011.
Brazilian Office Action dated Dec. 12, 2017, in related Brazilian Patent Application No. P10518583-1 (with English translation).
Russian Notice of Allowance dated Jan. 17, 2018, in related Russian Patent Application No. 2016145154/12 (072543) (with English translation).

(56) References Cited

OTHER PUBLICATIONS

Indian Office Action dated Feb. 13, 2018, in related Indian Patent Application No. 3278/CHENP/2011.

* cited by examiner (a)

(b)

(a)

(b)

(a)

(b)

(a)

(b)

(a)

(b)

(a)

(b)

(a)

(b)

(a)

(b)

DEVELOPER SUPPLY CONTAINER

This application is a divisional of application Ser. No. 15/583,374, filed May 1, 2017, now abandoned, which is a divisional of application Ser. No. 14/976,057, filed Dec. 21, 2015, now abandoned, which is a divisional of application Ser. No. 14/147,872, filed on Jan. 6, 2014, now abandoned, which is a divisional of application Ser. No. 13/349,998, filed on Jan. 3, 2013, now U.S. Pat. No. 8,649,711, issued Feb. 11, 2014, which is a divisional of application Ser. No. 13/091,558, filed on Apr. 21, 2011, now U.S. Pat. No. 8,131,189, issued on Mar. 6, 2012, which is a divisional of application Ser. No. 12/836,724, filed on Jul. 15, 2010, now U.S. Pat. No. 7,957,679, issued on Jun. 7, 2011, which is a divisional of application Ser. No. 12/189,273, filed on Aug. 11, 2008, now U.S. Pat. No. 7,796,923, issued on Sep. 14, 2010, which is a divisional of application Ser. No. 11/750,603, filed on May 18, 2007, now U.S. Pat. No. 7,412,192, issued on Aug. 12, 2008, which is a continuation of PCT/JP2005/022030, filed Nov. 24, 2005.

TECHNICAL FIELD

The present invention relates to a developer supply container for supplying a developer into a developer receiving apparatus. Examples of the developer receiving apparatus includes an image forming apparatus such as a copying machine, a facsimile machine, or a printer, an image forming unit detachably mountable to such an image forming apparatus.

BACKGROUND ART

Conventionally, a developer (toner) in the form of fine powder is used for image formation in the image forming apparatus such as a copying machine and/or printer of an electrophotographic type. In such an image forming apparatus, the developer is supplied from a developer supply container exchangeably set in the image forming apparatus with consumption of the developer.

Since the developer comprises extremely fine particles, there is a liability that developer scatters depending on the handling during a developer supply operation. Therefore, an image forming apparatus has been proposed and put into practice wherein the developer supply container is installed in the image forming apparatus, and the developer is discharged gradually through a small opening.

As for such a developer supply container, many types using a cylindrical container including a feeding member for stirring and feeding the developer therein have been proposed.

For example, Japanese Laid-open Patent Application Hei 7-199623 (U.S. Pat. No. 5,579,101) discloses a developer supply container having a coupling member for driving the feeding member therein. The coupling member of the developer supply container receives a driving force by engagement with a coupling member provided in the image forming apparatus side.

After such a developer supply container is inserted and mounted to the image forming apparatus, the user rotates the developer supply container through a predetermined angle, by which the developer supply container (developer supply) becomes operable. More particularly, by the rotation of the developer supply container, an opening provided in an outer surface of the developer supply container is brought into communication with an opening provided in the image forming apparatus side, thus enabling the supply of the developer.

However, in the case of the structure of the developer supply container of Japanese Laid-open Patent Application Hei 7-199623 (U.S. Pat. No. 5,579,101), the rotating operation for the developer supply container is carried out by the user, and therefore, there is a possibility that following inconvenience may arise.

If the user is not familiar with the operation for the developer supply container, the rotating operation for the developer supply container may be insufficient, so that developer supply container does not reach a predetermined operating position, with the result of abnormal developer supply.

DISCLOSURE OF THE INVENTION

Accordingly, it is an object of the present invention to provide a developer supply container having an improved operability.

It is another object of the present invention to provide a developer supply container wherein the structure for improving the operability is simplified.

The present invention is capable of attaining the object.

The present invention provides a developer supply container detachably mountable to a developer receiving apparatus, said developer supply container comprising an accommodating portion for accommodating a developer; a discharging member for discharging a developer from said containing portion; a drive transmission member, engageable with a driving member of said developer receiving apparatus, for transmitting a driving force to said discharging member; suppressing means having a variable suppressing force for suppressing a relative rotation between said developer supply container and said drive transmission member.

These and other objects, features and advantages of the present invention will become more apparent upon consideration of the following description of the preferred embodiments of the present invention taken in conjunction with the accompanying drawings.

DETAILED DESCRIPTION OF THE INVENTION

Examples of a developer supply container according to the present invention will be described. Various structures of the developer supply container may be replaced with other structures having the similar functions within the spirit of invention without particular a statement otherwise. The present invention is not intended to be limited to the structures of the developer supply container which will be described with the embodiments without a particular statement otherwise.

Embodiment 1

The structure of the image forming apparatus will first be described, and then, the structure of the developer supply container will be described.

(Image Forming Apparatus)

Figure 1:
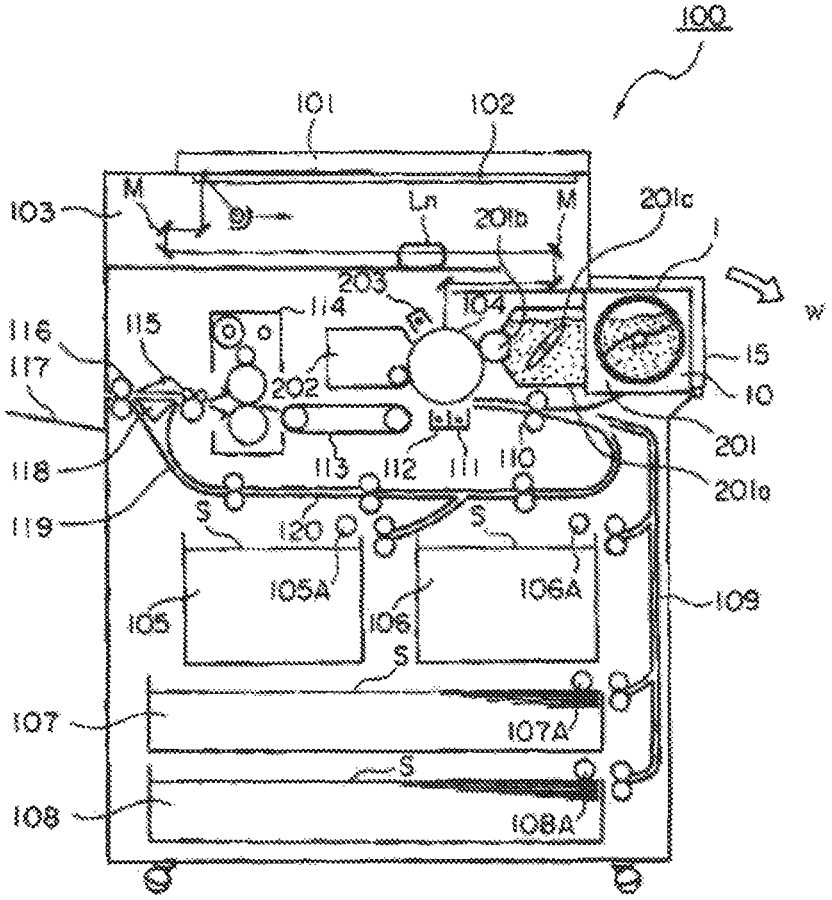
FIG. 1 is a sectional view illustrating a general arrangement of an image forming apparatus.
Figure 2:
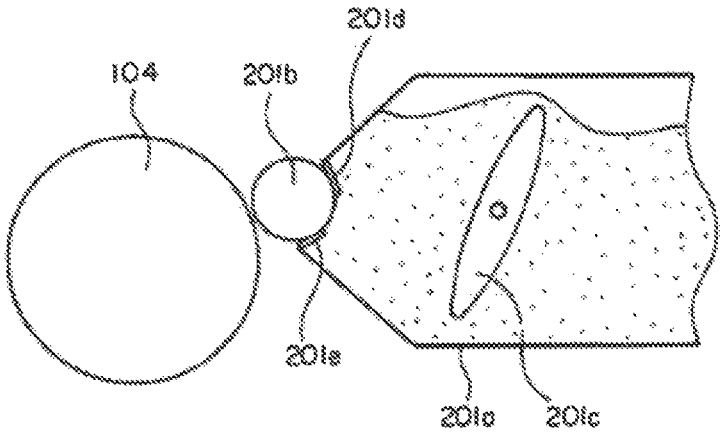
FIG. 2 is a partially sectional view illustrating a structure of a developing device.

Referring to FIG. 1, a structure of a copying machine employing an electrophotographic type process, will be described as an example of an image forming apparatus comprising a developer receiving apparatus which can be loaded with a developer supply container (so-called toner cartridge).

In FIG. 1, designated by 100 is a main assembly of the electrophotographic copying machine (main assembly of the apparatus 100). Designated by 101 is an original placed on an original supporting platen glass 102. A light image is formed on the electrophotographic photosensitive member 104 (photosensitive drum) as the image bearing member in accordance with the image information through an optical portion 103 including a plurality of mirrors M and a lens Ln, so that electrostatic latent image is formed. The electrostatic latent image is visualized with a developer by the developing device 201.

The developer in this example is toner. Therefore, the developer supply container accommodates the toner to be supplied. In the case of the image forming apparatus using the developer containing toner particles and carrier particles, the developer supply container may accommodate both of the toner and the carrier and may supply the mixture.

Designated by 105-108 are cassettes accommodating the recording materials (sheets) S. Among the cassettes 105-108, a proper cassette is selected on the basis of the sheet size of the original 101 or information inputted by the user on a liquid crystal operating portion of the copying machine. Here, the recording material is not limited to the sheet of paper, but may be an OHP sheet or the like.

One sheet S fed by a feeding and separating device 105A-108A is fed to the registration roller 110 through a feeding portion 109 and is then supplied in synchronism with the rotation of the photosensitive drum 104 and the scanning timing of the optical portion 103.

Designated by 111, 112 are a transfer discharger and a separation discharger. The image of the developer formed on the photosensitive drum 104 is transferred onto the sheet S by the transfer discharger 111. The separation discharger 112 separates the sheet S having the transferred developed image from the photosensitive drum 104.

The sheet S received by the feeding portion 113 is subjected to the heat and the pressure in the fixing portion 114 so that developed image on the sheet is fixed, and then the sheet S is passed through the discharging/reversing portion 115 and is discharged to the discharging tray 117 by the discharging roller 116, in the case of one-sided copy formation. In the case of superimposed copy, it is fed to the registration roller 110 through re-feeding portions 119, 120, and then is discharged to the discharging tray 117 through the path similar to the case of the one-sided copy.

In the case of the duplex copy, the sheet S is partly discharged to an outside of the apparatus by the discharging roller 116 temporarily through a discharging/reversing portion 115. Thereafter, the sheet S is fed into the apparatus by controlling the flapper 118 and by reverse rotation of the discharging roller 116, at proper timing when a terminal end of the sheet S has passed the flapper 118 but is still nipped by the discharging rollers 116. After it is fed to the registration roller 110 through the re-feeding portions 119, 120, it is discharged to the discharging tray 117 through the path similar to the case of the one-sided copy.

In the structure of the main assembly of the apparatus 100, image forming process equipment such as a developing device 201 as developing means, a cleaner portion 202 as cleaning means and a primary charger 203 as charging means are provided around the photosensitive drum 104. The cleaner portion 202 has a function of removing the developer remaining on the photosensitive drum 104. The primary charger 203 is to charge uniformly the surface of the photosensitive drum to prepare for desired electrostatic image formation on the photosensitive drum 104.

The developing device will be described.

The developing device 201 develops the electrostatic latent image formed on the photosensitive drum 104 by the optical portion 103 in accordance with the information of the original, by depositing the developer onto the electrostatic latent image. A developer supply container 1 for supplying the developer into the developing device 201 is detachably mounted to the main assembly of the apparatus 100 by the operator.

The developing device 201 comprises a developer receiving apparatus 10 for demountably mounting the developer supply container 1, and a developing device 201*a*, and the developing device 201*a* includes a developing roller 201*b* and a feeding member 201*c*. The developer supplied from the developer supply container 1 is fed to a developing roller 201*b* by a feeding member 201*c* and then is supplied to the photosensitive drum 104 by the developing roller 201*b*. The developing roller 201*b* is contacted by a developing blade 201*d* for regulating an amount of developer coating on the roller and contacted by a leakage preventing sheet 201*e* to prevent leakage of the developer.

As shown in FIG. 1, there is provided an exchange cover 15 for exchange of the developer supply container as a part of the outer casing of the copying machine, when the developer supply container 1 is mounted to or demounted from the main assembly of the apparatus 100 by the operator, the cover 15 is opened in the direction of arrow W.

(Developer Receiving Apparatus)

Figure 5:
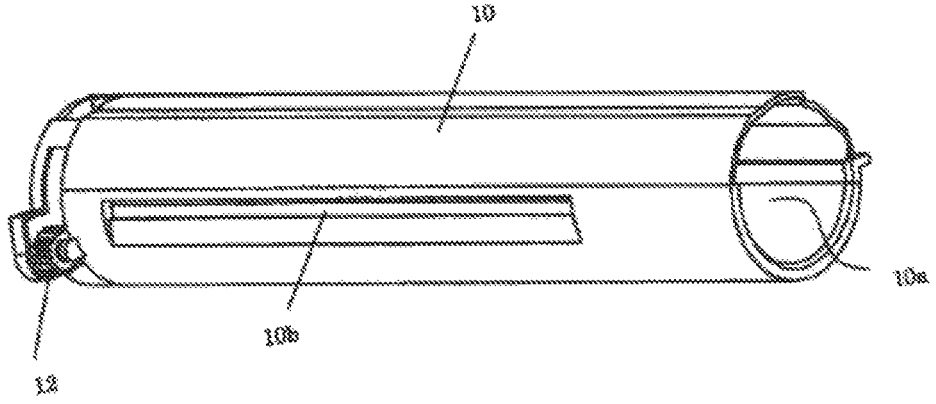
FIG. 5 illustrates a developer receiving apparatus according to the present invention, wherein (a) is a perspective view, and (b) is a perspective view.
Figure 5:
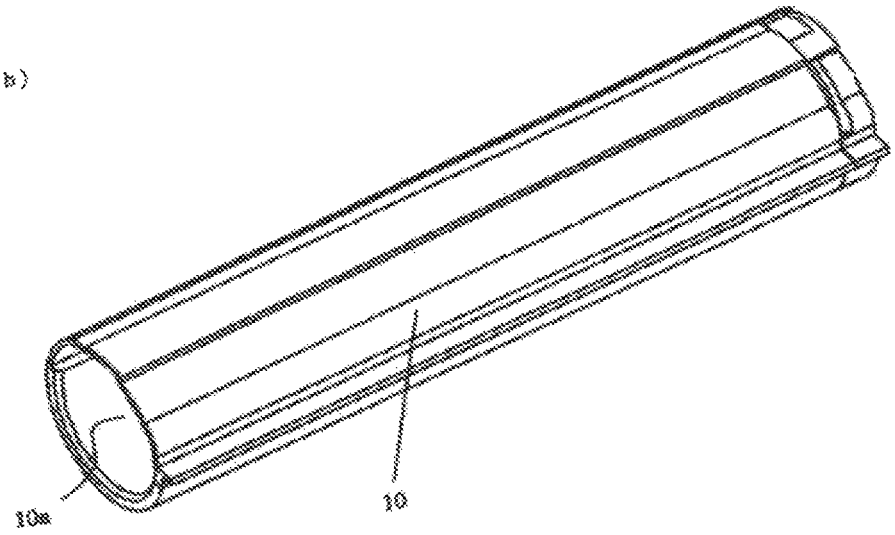
Figure 6:
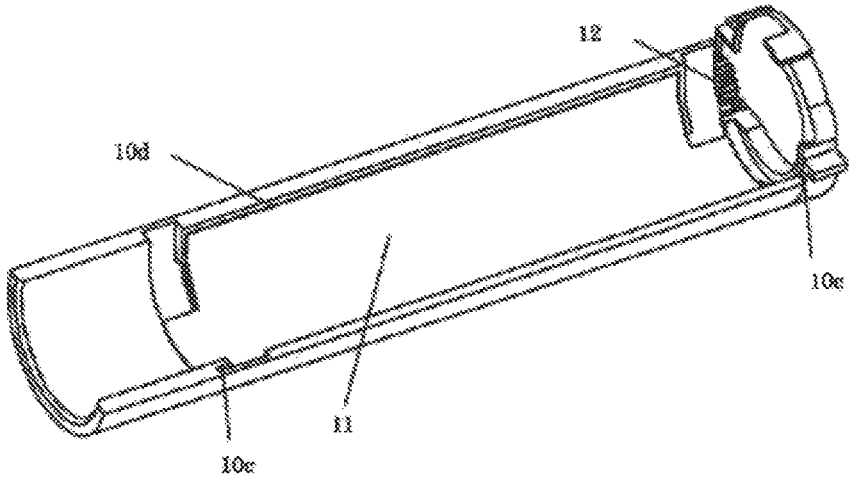
FIG. 6 illustrates an inside of a developer receiving apparatus according to the present invention wherein (a) and (b) are perspective views showing a state when a supply opening is unsealed.
Figure 6:
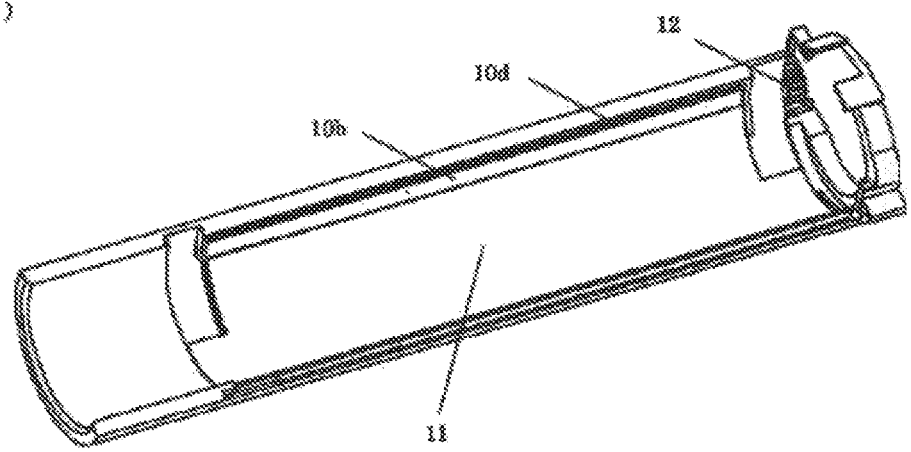

Referring to FIGS. 5 and 6, a structure of the developer receiving apparatus 10 will be described.

The developer receiving apparatus 10 comprises a containing portion 10*a* for demountably mounting the developer supply container 1, and a developer receiving opening 10*b* for receiving the developer discharged from the developer supply container 1. The developer supplied from the developer receiving opening is supplied to the developing device and is used for image formation.

There is provided a developing device shutter 11 having a semi-cylindrical configuration along the peripheral surface configurations of the developer supply container 1 and the containing portion 10*a*. The developing device shutter 11 is engaged with a guide portion 10*c* provided at a lower edge of the containing portion 10*a* and is slidable along a circumferential direction to open and close the developer receiving opening 10*b*.

The guide portion 10*c* is formed at each of the opposite edge portions of the developer receiving opening 10*b* which can be unsealed by movement of the developing device shutter 11.

When the developer supply container 1 is not mounted to the containing portion 10*a*, the developing device shutter 11 is at a sealing position sealing the developer receiving opening 10*b* by contacting one end thereof to a stopper 10*d* provided in the developer receiving apparatus 10 to prevent the developer from flowing back from the developing device to the containing portion 10*a*.

When the developing device shutter 11 is unsealed, the lower end of the developer receiving opening 10*b* and the upper end of the developing device shutter 11 are aligned with each other with high accuracy to completely open the developer receiving opening 10*b*. To accomplish this, a stopper 10*e* is provided to regulate an end position of the unsealing movement of the developing device shutter 11.

The stopper 10*e* functions also as a stop portion for stopping rotation of the container body at the position where the developer discharge opening 1*b* is opposed to the developer receiving opening 10*b*. Thus, the rotation of the developer supply container engaged with the developing device shutter 11 by an opening projection which will be described hereinafter is stopped by the stopper 10*e* stopping the unsealing movement of the developing device shutter 11.

One longitudinal end of the containing portion 10*a* is provided with a drive gear member 12 as a driving member for transmitting a rotational driving force from a driving motor provided in the main assembly of the image forming apparatus 100. As will be described hereinafter, the drive gear member 12 applies, to the second gear 6, a rotating force in the same direction as the rotating direction of the developer supply container for unsealing the developing device shutter, thereby to drive the feeding member 4.

In addition, the drive gear member 12 is connected with a driving gear train for rotating the feeding member 201*c* of the developing device, the developing roller 201*b*, and the photosensitive drum 104. The drive gear member 12 used in this example has a module of 1 and a teeth number of 17.

(Developer Supply Container)

Next, referring to FIGS. 3 and 4, the structure of the developer supply container 1 in this embodiment will be described.

The container body 1*a*, as a portion of the developer supply container 1, in which developer is stored, is roughly cylindrical. The cylindrical wall of this container body 1*a* is provided with a developer discharge opening 1*b*, which is in the form of a slit which extends in the direction parallel to the lengthwise direction of the container body 1*a*.

It is desired that this container body 1*b* is rigid enough to protect the developer therein and prevent the developer from leaking, before the developer supply container 1 is used for the first time, more specifically, during the shipment of the developer supply container 1. Thus, in this embodiment, the container body 1*a* is formed of polystyrene by injection molding. Incidentally, the choice of the resinous substance to be used as the material for the container body 1*a* does not need to be limited to polystyrene; other resinous substances, such as ABS, may be used.

The container body 1*a* is also provided with a handle 2, which is the portion of the container body 1*a*, by which the developer supply container 1 is to be held by a user when the user mounts or dismounts the developer supply container 1. It is also desired that this handle 2 be rigid to a certain degree as is the container body 1*a*. The handle 2 is formed of the same material as the material for the main structure of the container body 1*a*, and is formed by injection molding.

As for the method for fixing the handle 2 to the container body 1*a*, the handle 2 may be mechanically coupled with the container body 1*a*, or may be attached to the container body 1*a* with the use of screws. Further, it may be fixed to the container body 1*a* by gluing or welding. All that is required of the method for fixing the handle 2 to the container body 1*a* is that the method is capable of securing the handle 2 to the container body 1*a* so that the handle 2 does not become loose or separated from the container body 1*a* when the developer supply container 1 is mounted or dismounted. In this embodiment, the handle 2 is fixed to the container body 1*a* by being mechanically coupled with the container body 1*a*.

Figure 18:
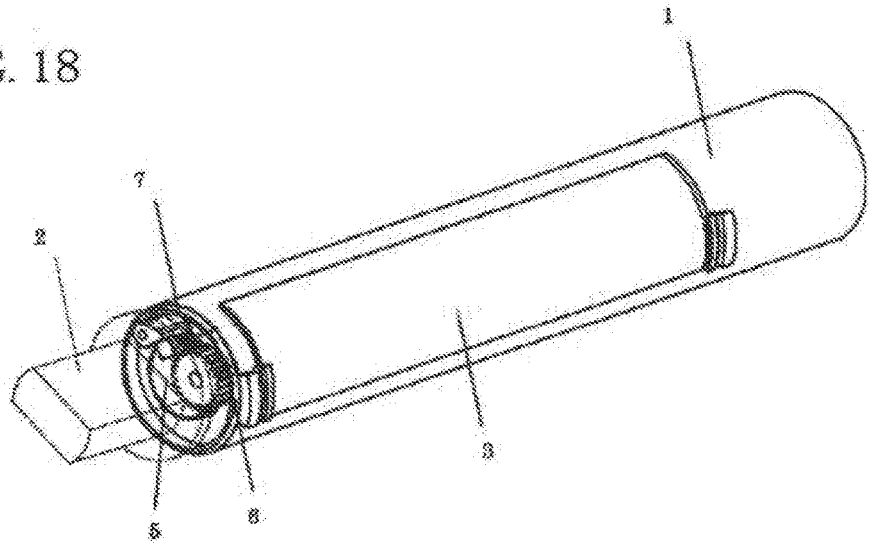
FIG. 18 is a perspective view illustrating a developer supply container according to the present invention.

Incidentally, the handle 2 may be structured differently from the above described one. For example, the handle 2 may be fixed to the container body 1*a* as shown in FIG. 18. In this case, the developer supply container 1 is provided with gears 5 and 6, which are attached to the rear end of the container body 1*a* in terms of the direction in which the developer supply container 1 is inserted into the main assembly of an image forming apparatus, and the handle 2 is attached to the container body 1*a* so that only the portion of the gear 6, by which the gear 6 engages with a driving gear member 12, remains exposed. This setup may be said to be superior to the above described one in that the drive transmitting means (gears 5 and 6) are protected by the handle 2.

Figure 19:
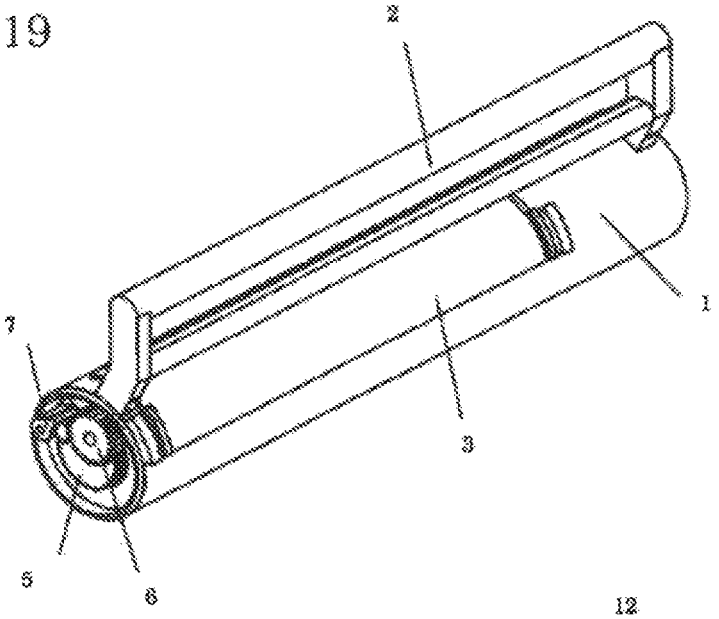
FIG. 19 is a perspective view (a) and a perspective view (b) illustrating a developer supply container according to the present invention.
Figure 19:
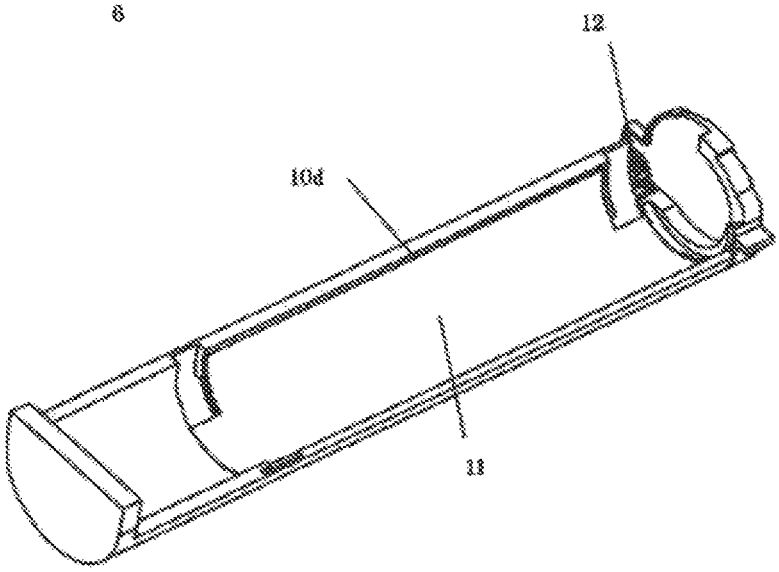

In this embodiment, the handle 2 is attached to one of the lengthwise ends of the container body 1*a*. However, the developer supply container 1 may be shaped as shown in FIG. 19(*a*), that is, long enough to reach from one lengthwise end of the container body 1*a* to the other, and is attached to the container body 1*a* at both lengthwise ends. In this case, the developer supply container 1 is mounted into the developer receiving device 10 from above, as shown in FIG. 19(*b*). The direction in which the developer supply container 1 is mounted into the developer receiving device 10 or dismounted therefrom is optional. All that is necessary is that it is chosen according to such factors as the apparatus structure.

The opposite end wall of the container body 1*a* (in terms of lengthwise direction of container body 1) from where the first gear is attached is provided with an opening 1*c* through which the container body 1*a* is filled with developer. This opening 1*c* is sealed with a sealing member (unshown) or the like after the filling of the container body 1*a* with developer.

Further, the developer discharge opening 1*b*, is positioned so that when the developer supply container 1 is in its operative position into which the developer supply container 1 is rotated by a preset angle (position in which developer supply container is after completion of operation for setting developer supply container) the developer discharging opening 1*b* faces roughly sideways, as will be described later. The developer supply container is structured so that it can be mounted into the developer receiving device, with the developer discharge opening 1*b* facing roughly upward.

(Container Shutter)

Next, the container shutter will be described.

Figure 3:
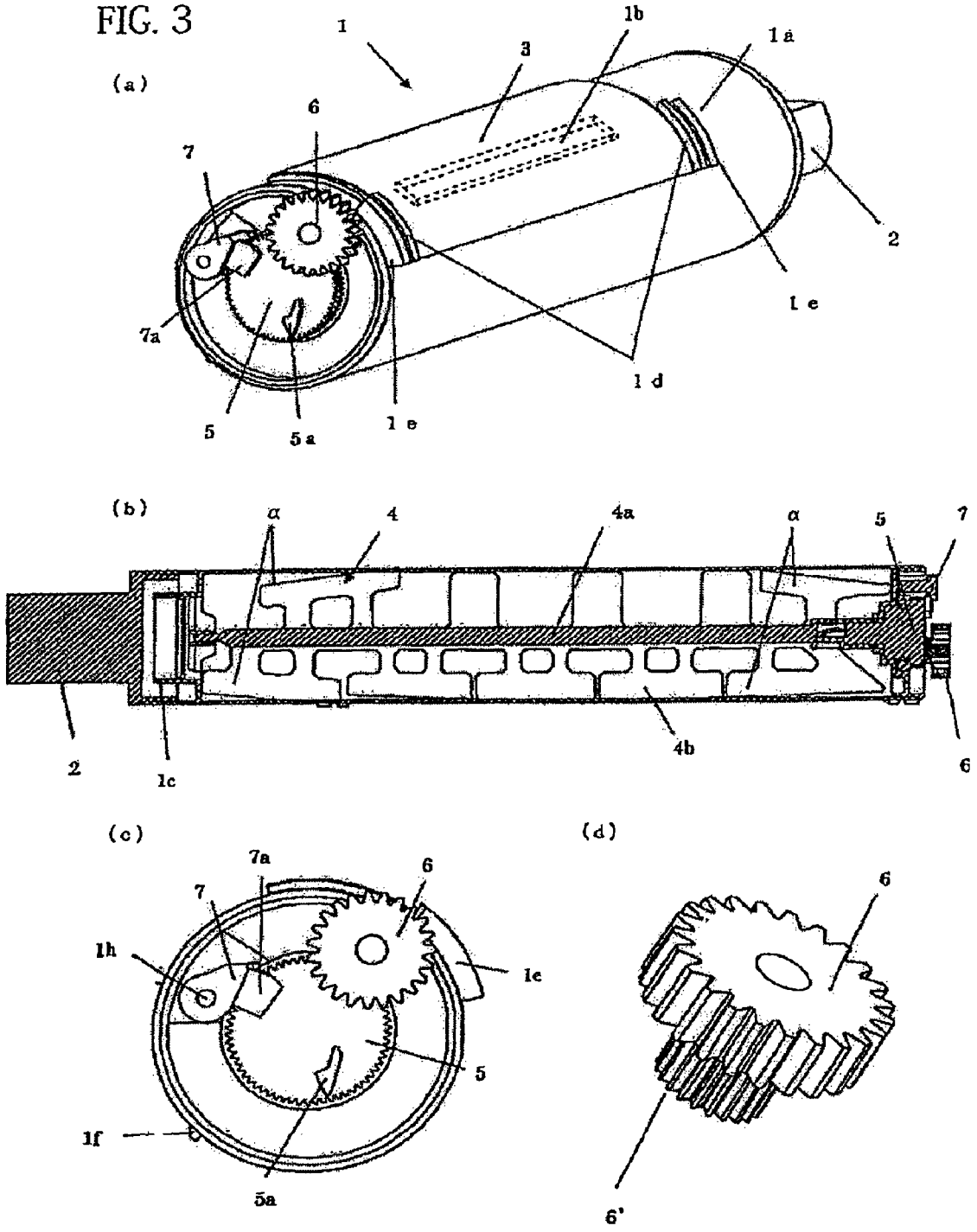
FIG. 3 illustrates a developer supply container according to the present invention wherein (a), (b) and (c) are a perspective view, a sectional view, and a side view, respectively, and (d) is perspective views of a second gear and a third gear.

Referring to FIG. 3(*a*), the developer supply container 1 is provided with a container shutter 3, the curvature of which roughly matches that of the cylindrical wall of the developer supply container 1, and the developer discharge opening 1*b* remains covered with this container shutter 3. The container shutter 3 is in engagement with a pair of guide portions 1*d* with which the lengthwise ends of the container body 1*a* are provided one for one. Not only does the guide portion 1*d* guide the container shutter 3 when the container shutter 3 slides in the direction to be opened or closed, but it also prevents the container shutter 3 from dislodging from the container body 1*a*.

In order to prevent the developer from leaking from the developer supply container 1, it is desired that the area of the surface of the container shutter 3, which opposes the developer discharge opening 1*b* when the container shutter 3 is in the closed position, is provided with a sealing member (unshown). Instead, the area of the cylindrical wall of the container body 1*a*, which is next to the developer discharge opening 1*b*, may be provided with a sealing member. Obviously, both the container shutter 3 and container body 1*a* may be provided with a sealing member. In this embodiment, however, only the container body 1*a* is provided with the sealing member.

Further, instead of providing the developer supply container 1 with a container shutter, such as the container shutter 3 in this embodiment, the developer discharge opening 1*b* may be hermetically sealed by welding a piece of sealing film formed of resin, to the area of the wall of the container body 1*a*, which surrounds the developer discharge opening 1*b*.

In this case, this sealing film is peeled away to unseal the developer discharge opening 1*b* (developer supply container 1).

In the case of this structural arrangement, however, it is possible that when a developer supply container 1, which has become depleted of developer, is replaced, a small amount of developer which is still remaining in the developer supply container 1 will come out of the developer discharge opening 1*b* and scatter. Therefore, it is desired to provide the developer supply container 1 with the container shutter 3, as in this embodiment, so that the developer discharge opening 1*b* can be resealed.

Needless to say, there are various developer supply containers, which are different in the shape of the developer discharge opening 1*b*, developer capacity, etc. Therefore, if there is the possibility that because of the unusual shape of the developer discharge opening 1*b*, large developer capacity, etc., the developer will leak before the developer supply container 1 is used for supplying an image forming apparatus with developer, more specifically, while the developer supply container 1 is shipped, the developer supply container 1 may be provided with both the sealing film and container shutter described above, in order to ensure that the developer discharge opening 1*b* remains satisfactorily sealed.

(Conveying Member)

Next, the conveying member mounted in the developer supply container 1 will be described.

The developer supply container 1 is provided with a conveying member 4, which is located in the hollow of the container body 1*a*. The conveying member 4 is a discharging member which is rotated for conveying, while stirring, the developer in the container body 1*a*, upward toward the developer discharge opening 1*b* from the bottom portion of the container body 1*a*. Referring to FIG. 3(*b*), the conveying member 4 is made up of primarily a stirring shaft 4*a* and stirring wing 4*b*.

The stirring shaft 4*a* is rotatably supported by the container body 1*a*, at one of its lengthwise ends, so that it is virtually impossible for the stirring shaft 4*a* to move in its lengthwise direction. The other lengthwise end of the stirring shaft 4*a* is connected to the first gear 5 so that the stirring shaft 4*a* and gear 5 are coaxial. More concretely, the other lengthwise end of the stirring shaft 4*a* and the first gear 5 are connected to each other by fitting the shaft portion of the first gear 5 into the receptacle-like recess with which the lengthwise end of the stirring shaft 4*a* is provided. Further, in order to prevent the developer from leaking through the gap next to the circumferential surface of the shaft portion of the first gear 5, this portion of the shaft portion of the first gear 5 is fitted with a sealing member.

Incidentally, instead of directly connecting the first gear 5 to the stirring shaft 4*a*, the two may be indirectly connected to each other, with the placement of another member capable of transmitting driving force from the first gear 5 to the stirring shaft 4*a*.

It is possible that the developer in the developer supply container 1 will agglomerate and solidify. Thus, it is desired that the stirring shaft 4*a* is rigid enough to loosen the agglomerated developer to convey the developer, even if the developer in the developer supply container 1 agglomerates and solidifies. Further, it is desired that the stirring shaft 4*a* be as small as possible in its friction relative to the container body 1*a*. In this embodiment, therefore, polystyrene is employed as the material for the stirring shaft 4*a*, from the standpoint of the above described desires. Of course, the material for the stirring shaft 4*a* does not need to be limited to polystyrene; other substances, such as polyacetal, may be employed.

The stirring wing 4*b* is firmly secured to the stirring shaft 4*a*. It is for conveying the developer in the developer supply container 1 toward the developer discharge opening 1*b*, while stirring the developer, as the stirring shaft 4*a* is rotated. In order to minimize the amount of the developer which cannot be discharged from the developer supply container 1, the dimension of the stirring wing 4*b*, in terms of the radius direction of the developer supply container 1, is rendered large enough for a proper amount of contact pressure to be generated between the edge of the stirring wing 4*b* and the internal surface of the developer supply container 1 as the former slides on the latter.

Referring to FIG. 3(*b*), the leading end portions (portions α in FIG. 3(*b*)) of the stirring wing 4*b* are formed roughly in the shape of letter L. Thus, as the conveying member 4 is rotated, these portions α fall slightly behind the rest of the conveying member 4, nudging thereby the developer toward the developer discharge opening 1*b*. In other words, the conveying member 4 also has the function of conveying the developer toward the developer discharge opening 1*b* using these roughly L-shaped portions. In this embodiment, the stirring wing 4*b* is formed of a sheet of polyester. Needless to say, the material for the stirring wings 4*b* does not need to be limited to a sheet of polyester; other resinous substances may be employed, as long as a sheet formed of a selected substance is flexible.

The structure of the conveying member 4 does not need to be limited to the above described one, as long as the conveying member 4 can fulfill its required function of conveying the developer to discharge the developer from the developer supply container 1 by being rotated; various structures may be employed. For example, the above described conveying member 4 may be modified in the material, shape, etc., of the stirring wing 4*b*. Further, a conveying mechanism different from the above described one may be employed. In this embodiment, the first gear 5 and conveying member 4 are two components which are independently formed, and are integrated into a single piece by being coupled with each other. However, the first gear 5 and the stirring shaft 4*a* may be integrally molded of resin.

(Mechanism for Opening or Closing Developer Container Shutter)

Next, the mechanism for opening or closing the developer container shutter will be described.

Referring to FIG. 3(*c*), the container body 1*a* is provided with an unsealing projection 1*e* and a sealing projection 1*f*, which are for moving the developing device shutter 11. The unsealing and sealing projections 1*e* and 1*f* are on the circumferential surface of the container body 1*a*.

The unsealing projection 1*e* is a projection for pressing down the developing device shutter 11 (FIG. 6) to unseal the developer receiving opening 10*b* (FIG. 6) during the setup operation (which is for rotating developer supply container into operative position (replenishment position) by rotating developer supply container by preset angle) which is carried out after the mounting of the developer supply container 1 into the developer receiving device 10 (image forming apparatus).

The sealing projection 1*f* is for pushing up the developing device shutter 11 (FIG. 6) to seal the developer receiving opening 10*b* (FIG. 6) during the developer supply container removal operation (which is for reversely rotating developer supply container by preset angle from its operative position (replenishment position) to position into which developer supply container is mountable, or from which developer supply container is dismountable).

In order to cause the developing device shutter 11 to be opened or closed by the operation for rotating the developer supply container 1, the positional relationship between the unsealing projection 1*e* and sealing projection 1*f* are set as follows:

That is, they are positioned so that when the developer supply container 1 is in the proper position in the developer receiving device 10 (FIG. 6), the unsealing projection 1*e* is on the upstream side of the developing device shutter 11 in terms of the direction in which the developing device shutter 11 is opened, and the sealing projection 1*f* is on the downstream side.

Figure 21:
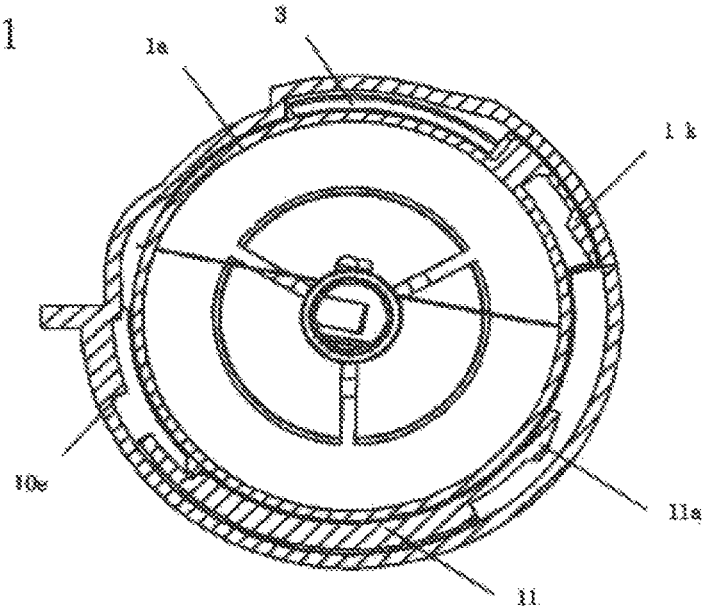
FIG. 21 is a sectional side view (a) illustrating a snap fit portion according to the present invention, and a perspective view (b) thereof.
Figure 21:
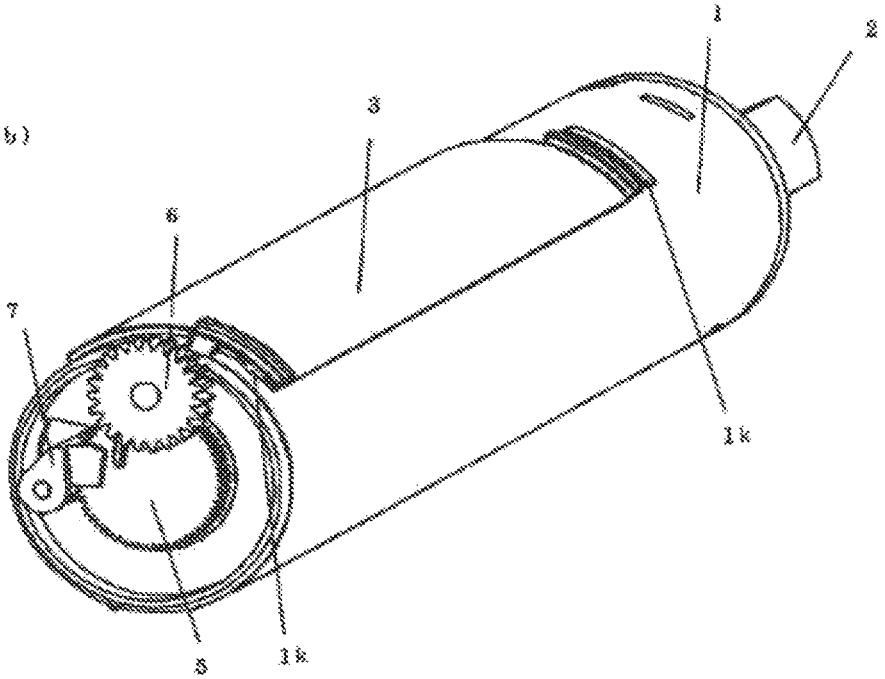

In this embodiment, the developer supply container 1 and developer receiving device 10 are structured so that the developing device shutter 11 is opened or closed with the use of the unsealing projection 1*e* and sealing projection 1*f*. However, they may be structured as shown in FIG. 21.

More concretely, the container body 1*a* is provided with a snap-fitting claw 1*k*, which is a hook (which moves with developing device shutter 11) which can be engaged with, or disengaged from, the developing device shutter 11. The snap-fitting claw 1*k* is on the outward circumferential surface of the container body 1*a* (it is the same in position as unsealing projection 1*e*).

To describe in more detail, the developer supply container 1 and developer receiving device 10 are structured so that this snap-fitting claw 1*k* snaps into the engaging portion (recess) of the developing device shutter 11 from above, and as the container body 1*a* is rotated, the snap-fitting claw 1*k* presses down, or pulls up, the developing device shutter 11 engaged therewith, to open, or close, the developing device shutter 11. The connective portion 11*a* of the developing device shutter 11, which engages with the snap-fitting claw 1*k*, matches in shape to the snap-fitting claw 1*k* so that two sides properly engage with each other.

Further, the developer supply container 1 and developer receiving device 10 are structured so that once the developing device shutter 11 is pulled up by the rotation of the container body 1*a* by a distance large enough to satisfactorily reseal the developer discharge opening 1*b*, the developing device shutter 11 cannot be rotated further, as will be described later. If the developer supply container 1 is further rotated after the developing device shutter 11 has reached the location at which it can keep the developer discharge opening 1*b* satisfactorily sealed, the snap-fitting claw portion 1*k* becomes disengaged from the developing device shutter 11, and therefore, the developer supply container 1 allowed to rotate relative to the developing device shutter 11, causing the developer discharge opening 1*b* to be resealed. As described above, the snap-fitting claw portion 1*k* is adjusted in resiliency so that it is allowed to become disconnected from the developing device shutter 11.

(Drive Transmitting Means)

Next, the structure of the drive transmitting means for transmitting the rotational driving force received from the developer receiving device 10, to the conveying member 4, will be described.

The developer receiving device 10 is provided with a driving gear member 12, which is a driving member for providing the developer supply container 1 with rotational force.

On the other hand, the developer supply container 1 is provided with a drive transmitting means, which engages with the driving gear member 12 and transmits to the conveying member 4 the rotational driving force received from the driving gear member 12.

In this embodiment, the drive transmitting means has a gear train, the rotational shaft of each of the gears of which is directly and rotatably supported by the walls of the developer supply container 1, as will be described later.

Also in this embodiment, after the mounting of the developer supply container 1, the developer supply container 1 is to be rotated by the preset angle into its operative position (replenishment position), with the use of the handle 2. Prior to this setup operation, the drive transmitting means and driving gear member 12 are not in engagement with each other (disengaged state); there is a certain amount of distance between the two in terms of the circumferential direction of the developer supply container 1. Then, as the developer supply container 1 is rotated with the use of the handle 2, the drive transmitting means and the driving gear member 12 meet and engage with each other (engaged state).

More concretely, the first gear 5 (driving force relaying member), as the drive transmitting means, which is in connection with the conveying member 4, is supported by its shaft portion by one of the lengthwise ends of the container body 1*a* so that the first gear 5 is rotatable about the rotational axis (approximate rotational axis) of the developer supply container 1. The first gear 5 is coaxially rotatable with the conveying member 4.

The first gear 5 is attached so that its rotational axis roughly coincides with the rotational axis of the developer supply container 1, about which the developer supply container 1 is rotated by the preset angle during the setup operation.

The second gear 6 (driving force transmitting member, or driving force transmitting eccentric member), as a part of the drive transmitting means, is attached to the container body 1*a* by a shaft so that the second gear 6 is orbitally rotated about the rotational axis of the developer supply container 1. The second gear 6 is attached to the container body 1*a* so that it can be engaged with the driving gear member 12 of the developer receiving device 10 to receive rotational driving force from the driving gear member 12. Further, the second gear 6 is structured as a step gear, as shown in FIG. 3(*d*). That is, the second gear 6 is provided with a third gear 6', which meshes with the first gear 5, so that it can transmit rotational driving force to the first gear 5.

The second gear 6 and driving gear member 12 mesh with each other so that as the second gear 6 is driven by the driving gear member 12 in the opposite direction from the direction in which the container body 1*a* is rotated in the setup operation, the second gear 6 rotates in the same direction as the direction in which the container body 1*a* is rotated in the setup operation.

Incidentally, the direction in which the container body 1*a* is rotated in the setup operation is the same as the direction in which the developing device shutter 11 is rotated to unseal the developer discharge opening 1*b*.

As described above, as rotational driving force is inputted from the driving gear member 12 to the second gear 6, the third gear 6', which is an integral part of the second gear 6, and the first gear 5 which is in mesh with the second gear 6 and drivable by the second gear 6, rotate, whereby the conveying member 4 in the container body 1*a* is rotated.

As described before, immediately after the mounting of the developer supply container 1 into the developer receiving device 10, there is a certain amount of distance between the second gear 6 and the driving gear member 12 of the developer receiving device 10, in terms of the circumferential direction of the container body 1*a*.

Then, as the operation for rotating the developer supply container 1 is carried out by a user, the second gear 6 becomes engaged with the driving gear member 12, being readied to be driven by the driving gear member 12. At this point in the operation, there is no passage between the developer discharge opening 1*b* and developer receiving opening 10*b* (developing device shutter 11 remains closed).

Thereafter, driving force is inputted into the driving gear member 12 of the developer receiving device 10, as will be described later.

As described above, the position of the second gear 6 relative to the developer supply container 1 (relative to unsealing projection 1*e* or developer discharge opening 1*b*), in terms of the circumferential direction of the container body 1*a* is adjusted so that the second gear 6 and driving gear member 12 begin to mesh with each other at the abovementioned time to transmit driving force. Therefore, the second gear 6 and first gear 5 are attached to the container body 1*a* so that they are different in the position of their rotational axes.

In this embodiment, the container body 1*a* is a hollow cylinder. Therefore, the rotational axis of the conveying member 4 and that of the container body 1*a* coincide (roughly), and the rotational axis of the first gear 5 which is in direct connection with the conveying member 4 coincides (roughly) with the rotational axis of the container body 1*a*, whereas the rotational axis of the second gear 6 is deviated from that of the first gear 5 so that as the developer supply container 1 is rotated, the second gear 6 orbitally rotates about the rotational axis of the first gear 5 and meshes with the driving gear member 12 of the developer receiving device 10. Thus, the rotational axis of the second gear 6 is offset from the rotational axis of the container body 1*a*.

Incidentally, the rotational axis of the conveying member 4 may be offset from that of the rotational axis of the container body 1*a*. For example, the rotational axis of the conveying member 4 may be offset toward the developer discharge opening 1*b* (in diameter direction). In this case, it is desired that the first gear 5 is reduced in diameter, and is attached by its rotational shaft to the portion of the container body 1*a*, which is different from the portion of the container body 1*a*, which coincides with the rotational axis of the container body 1*a*. Otherwise, the structure arrangement may be the same as the preceding structural arrangement.

Further, if the rotational axis of the conveying member 4 is offset from the rotational axis of the container body 1*a*, the drive transmitting means may be made up of the second gear 6 alone, that is, without the first gear 5. In such a case, the second gear 6 is supported by a shaft attached to the portion of the container body 1*a*, which is offset from the rotational axis of the container body 1*a*. Also in such a case, the second gear 6 is connected to the conveying member 4 so that it coaxially rotates with the conveying member 4.

Also in such a case, the rotational direction of the conveying member 4 is opposite to that in the preceding example described above. That is, the developer is conveyed downward toward the developer discharge opening 1*b* from the top portion of the container body 1*a*. Therefore, the conveying member to be used in this setup is desired to have such a function that it lifts the developer in the container body 1*a* upward by rotating about its own axis, and then, guides the body of developer, which it has lifted, toward the developer discharge opening 1*b*, which is at a lower level than the level at which the lifted body of developer is.

It is desired that the first and second gears 5 and 6 have the function of satisfactorily transmitting the driving force transmitted thereto from the developer receiving device 10. In this embodiment, polyacetal is employed as their material, and they are made by injection molding.

To describe in more detail, the first gear 5 is 0.5 in module, 60 in tooth count, and 30 mm in diameter. The second gear 6 is 1 in module, 20 in tooth count, and 20 mm in diameter. The third gear 6' is 0.5 in module, 20 in tooth count, and 10 mm in diameter. The rotational axis of the second gear 6 and the rotational axis of the third gear are offset by 20 mm from the rotational axis of the first gear in the diameter direction of the first gear.

Incidentally, all that is necessary here is that the module, tooth count, and diameter of each of these gears are set in consideration of their performance in terms of driving force transmission. In other words, they do not need to be limited to those described above.

Figure 15:
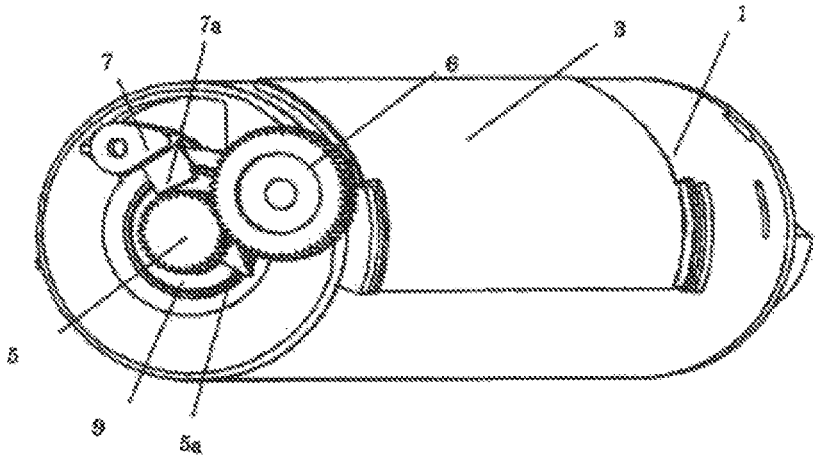
FIG. 15 is a perspective view illustrating a developer supply container according to the present invention.

For example, the diameters of the first and second gears 5 and 6 may be 20 mm and 40 mm, respective, as shown in FIG. 15. In this case, however, the points of the container body 1*a*, in terms of the circumferential direction of the container body 1*a*, to which they are attached, need to be adjusted so that the operation for setting up the developer supply container 1, which will be described later, can be satisfactorily carried out.

In the case of the above described modified version of this embodiment, the speed at which the developer is discharged from the developer supply container 1 (rotational speed of conveying member) is higher (rotational speed of driving gear member 12 of developer receiving device 10 remains the same) than that in this embodiment, because of the change in gear ratio. Further, it is possible that the amount of torque necessary to convey the developer while stirring the developer is higher than that in this embodiment. Therefore, it is desired that the gear ratio is set in consideration of the type (difference in specific weight, for example, which is affected by whether developer is magnetic or nonmagnetic) of the developer in the developer supply container 1, amount by which developer supply container 1 is filled with developer, etc., as well as the amount of the output of the driving motor.

If it is desired to further increase the developer discharge speed (rotational speed of conveying member), all that is necessary is to reduce the diameter of the first gear 5 and/or increase the diameter of the second gear 6. On the other hand, if the torque is the primary concern, all that is necessary is to increase the diameter of the first gear 5 and/or reduce the diameter of the second gear 6. In other words, the diameters of the first and second gears 5 and 6 may be selected according to the desired specifications.

Incidentally, in this embodiment, the developer supply container 1 is structured so that if the developer supply container 1 is viewed from the direction parallel to its lengthwise direction, the second gear 6 partially protrudes beyond the outer circumference of the container body 1*a*, as shown in FIG. 3. However, the developer supply container 1 may be structured to position the second gear 6 so that the second gear 6 does not protrude beyond the outer circumference of the container body 1*a*. This structural arrangement is superior to the structural arrangement in this embodiment, in terms of how efficiently and securely the developer supply container 1 can be packaged. Therefore, this structural arrangement can reduce the probability with which an accident such as the developer supply container 1 is damaged because the package which contains the developer supply container 1 is accidentally dropped during shipment or in the like situation, occurs.

(Method for Assembling Developer Supply Container)

The method for assembling the developer supply container 1 in this embodiment is as follows: First, the conveying member 4 is inserted into the container body 1*a*. Then, after the first gear 5 and container shutter 3 are attached to the container body 1*a*, the second gear 6, and the third gear 6' which is integral with the second gear 6, are attached to the container body 1*a*. Thereafter, developer is filled into the container body 1*a* through the developer filling opening 1*c*, and the developer filling opening 1*c* is sealed with the sealing member. Lastly, the handle 2 is attached.

The above described order in which the operation for filling the developer into the container body 1*a*, and the operations for attaching the second gear 6, container shutter 3, and handle 2, are carried out, is optional; it may be changed for the ease of assembly.

Incidentally, in this embodiment, a hollow cylinder which is 50 mm in internal diameter and 320 mm in length, is used as the container body 1*a*, and therefore, the container body 1*a* is roughly 60 cc in volumetric capacity. Further, the amount of the developer filled into the developer supply container 1 is 300 g.

(Torque Generating Mechanism)

Next, referring to FIGS. 3 and 4, the torque generating mechanism as the suppressing means for rotating the developer supply container 1 toward its operative position (refilling position) using the above described drive transmitting means, will be described.

In this embodiment, for structural simplification, the drive transmitting means for transmitting rotational driving force to the conveying means is used as the mechanism for automatically rotating the developer supply container 1 toward its operative position.

That is, in this embodiment, the drive transmitting means is utilized to generate the force for pulling the container body 1*a* to automatically rotate the container body 1*a* toward its operative position.

More concretely, the rotational load (which hereafter will be referred to as torque) of the second gear 6 relative to the container body 1*a* is increased by increasing the rotational load of the first gear 5 relative to the container body 1*a*.

Therefore, as the driving force from the driving gear member 12 is inputted into the second gear 6, which is in mesh with the driving gear member 12, rotational force is generated in the container body 1*a*, because the second gear 6 is in the state in which it is prevented (restrained) from rotating relative to the container body 1*a*. As a result, the container body 1*a* automatically rotates toward its operative position.

That is, in order to automatically rotate the developer supply container 1, the second gear 6 is kept under the suppressive force from the torque generating mechanism so that the drive transmitting means and developer supply container 1 are prevented (restrained) from rotating relative to each other. In other words, the second gear 6 is kept in the state in which the rotational load of the drive transmitting means relative to the developer supply container 1 is greater than the amount of force necessary to automatically rotate the developer supply container 1.

Incidentally, although, hereafter, the structural arrangement for making the torque generating mechanism on the first gear 5 will be described, the same structural arrangement may be used to make the torque generating mechanism act on the second gear 6.

Figure 4:
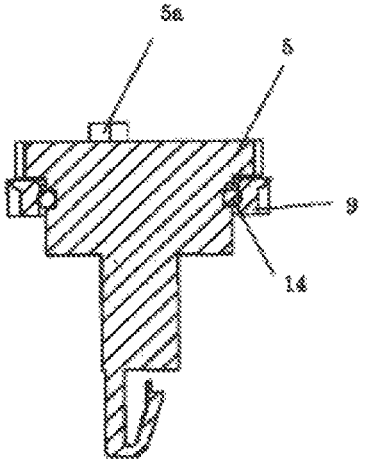
FIG. 4 illustrates a structure of the developer supply container according to the present invention, wherein (a) is a sectional view of a torque generating portion, and (b) is an exploded view of the torque generating portion.
Figure 4:
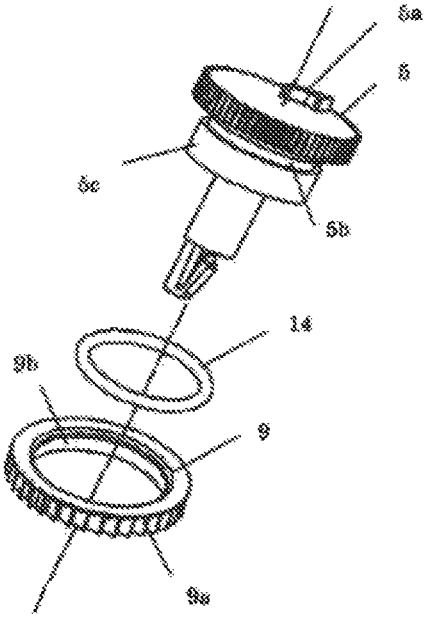

Referring to FIG. 4, the first gear 5 is provided with a locking member 9, as a suppressing means (means for increasing rotational load), which is in the form of a ring and is fitted in the groove 5*b* with which the peripheral surface 5*c* of the first gear 5 is provided. The locking member 9 is enabled to rotate relative to the first gear 5 about the rotational axis of the first gear 5. The entirety of the outer circumferential portion of the locking member 9 constitutes a hooking (catching) portion 9*a*, which is made up of multiple teeth like the teeth of a saw.

There is a ring 14 (so-called O-ring) as the suppressing means (rotational load increasing means), between the outer circumferential surface 5*c* of the shaft portion of the first gear 5 and the inner circumferential surface 9*b* of the locking member 9. The ring 14 is kept in the compressed state. Further, the ring 14 is secured to the outer circumferential surface 5*c* of the first gear 5. Therefore, as the locking member 9 is rotated relative to the first gear 5, torque is generated due to the presence of friction between the inner circumferential surface 9*b* of the locking member 9 and the compressed ring 14. This is how the torque is generated.

Incidentally, in this embodiment, the saw-toothed catching portion 9*a* makes up the entirety of the outer circumferential portion of the locking member 9 in terms of its circumferential direction. In principle, the catching portion 9*a* may make up only a part of the outer circumferential portion of the locking member 9. Further, the catching portion 9*a* may be in the form of a projection or a recess.

It is desired that an elastic substance, such as rubber, felt, foamed substance, urethane rubber, elastomer, etc., which is elastic, is used as the material for the ring 14. In this embodiment, silicon rubber is used. Further, a member which is not in the form of a full ring, that is, a member which appears as if it were formed by removing a part from a full ring, may be employed in place of the ring 14.

In this embodiment, the outer circumferential surface 5*c* of the first gear 5 is provided with a groove 5*b*, and the ring 14 is secured to the first gear 5 by being fitted in the groove 5*b*. However, the method for securing the ring 14 does not need to be limited to the method used in this embodiment. For example, the ring 14 may be secured to the locking member 9 instead of the first gear 5. In such a case, the outer circumferential surface 5*c* of the first gear 5 and the inner surface of the ring 14 slide relative to each other, and the friction between the two surfaces generates the torque. Further, the ring 14 and first gear 5 may be two portions of a single component integrally formed by so-called two color injection molding.

Figure 11:
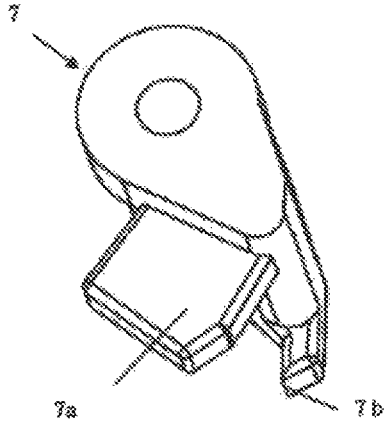
FIG. 11 is a perspective view illustrating a locking member according to the present invention.

Referring to FIG. 3(*c*), the container body 1*a* is provided with a shaft 1*h* which protrudes from the end surface of the container body 1*a*, which is on the side where the above-mentioned gears are. A locking member 7 as a suppressing means (rotational load increasing means) for regulating the rotation of the locking member 9 is fitted around the shaft 1*h* as the locking member supporting member so that the locking member 7 is displaceable. Referring to FIG. 11, the locking member 7 is made up of a locking member disengaging portion 7*a* and a locking member engaging portion 7*b*. Incidentally, the locking member 7 functions as the means for changing (switching) the rotational load of the second gear 6 relative to the container body 1*a*. This function will be described later in detail. That is, the locking member 7 also functions as the means for changing the amount of force which suppresses the rotation of the developer supply container 1 relative to the drive transmitting means.

Next, referring to FIGS. 13(*a*) and 13(*b*), the relationship between the locking member 7 and locking member 9 will be described.

Figure 13:
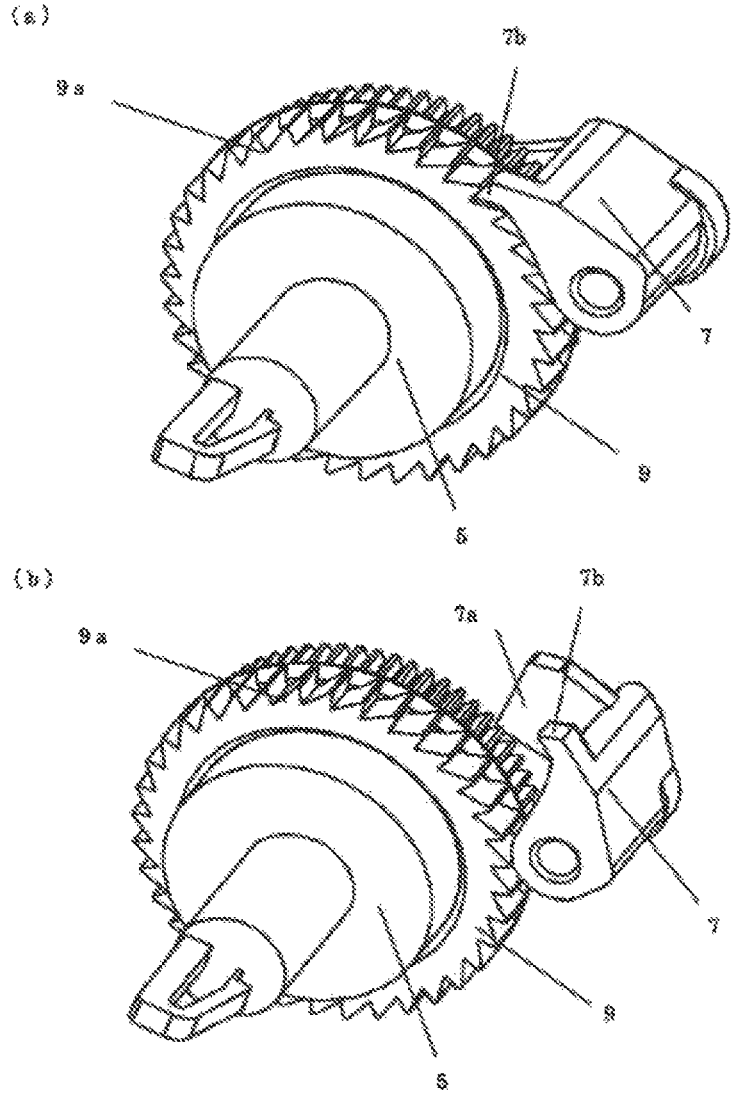
FIG. 13 deals with switching of a torque load according to the present invention, wherein (a) is a perspective view illustrating a state of a large torque load, (b) is a perspective view illustrating a state of a small torque load.

Referring to FIG. 13(*a*), while the engaging portion 7*b* is in engagement with the catching portion 9*a* of the locking member 9, the locking member 9 is prevented from rotating relative to the container body 1*a*. Thus, if driving force is inputted into the first gear 5 from the driving gear member 12 through the second gear 6 while these components are in the state shown in FIG. 13(*a*), the rotational load (torque) of the first gear 5 is greater, because the ring 14 remains compressed between the inner circumferential surface 9*b* of the locking member 9 and the shaft portion of the first gear 5.

On the other hand, referring to FIG. 13(*b*), while the engaging portion 7*b* is not in engagement with the catching portion 9*a* of the locking member 9, the locking member 9 is not prevented from rotating relative to the container body 1*a*. Thus, if driving force is inputted into the first gear 5 from the driving gear member 12 through the second gear 6 while these components are in the state shown in FIG. 13(*b*), the locking member 9 rotates with the first gear 5. In other words, the amount by which the rotational load of the first gear 5 is increased by the locking member 9 and ring 14 is cancelled, and therefore, the rotational load (torque) of the first gear 5 is sufficiently smaller to allow the locking member 9 to rotate with the first gear 5.

Incidentally, in this embodiment, the torque is generated by increasing the friction between the first gear 5 and locking member 9 by sandwiching the ring 14 between the first gear 5 and locking member 9. However, the friction between the first gear 5 and locking member 9 may be increased with the employment of the structural arrangement other than the structural arrangement used in this embodiment. For example, a structural arrangement which uses the magnetic attraction (magnetic force) between the magnetic S and N poles, a structural arrangement which uses the changes in the internal and external diameters of a spring, which occur as the spring is twisted, or the like, may be employed.

(Mechanism for Switching Rotational Load)

Next, the mechanism for switching the rotational load of the drive transmitting means relative to the developer supply container 1 will be described.

The first gear 5 is provided with a disengagement projection 5*a* (FIGS. 4, 9, etc.) as an unlocking portion, which protrudes from the end surface of the first gear 5. The disengagement projection 5*a* is structured so that as the first gear 5 rotates relative to the developer supply container 1 while the developer supply container 1 is in the operative position (refilling position), it collides with the disengaging portion 7*a* of the locking member 7.

That is, as the first gear 5 rotates, the disengagement projection 5*a* pushes up the disengaging portion 7*a*, causing the engaging portion 7*b* to disengage from the catching portion 9*a* of the locking member 9. In other words, the disengagement projection 5*a* has the function of instantly dissolving the state in which the first gear 5 is under the rotational load.

That is, the state in which the drive transmitting means is prevented (restrained) from rotating relative to the developer supply container 1 after the automatic rotation of the developer supply container 1 is dissolved. In other words, the rotational load borne by the drive transmitting means relative to the developer supply container 1 is sufficiently reduced.

As described above, the torque generating mechanism in this embodiment does not completely lock the first gear 5, that is, does not completely prevent the first gear 5 from rotating relative to the container body 1*a*. Rather, it increases the rotational load to such an amount that allows the first gear 5 to rotate relative to the developer supply container 1 once the operation for rotating the developer supply container 1 into its operative position is completed.

Incidentally, in this embodiment, the locking members 7 and 9 are disengaged from each other so that the rotational load which the torque generating mechanism generates is cancelled. However, all that is necessary is that after the disengagement, the amount of the rotational load is smaller than at least the amount of the rotational load necessary to automatically rotate the developer supply container 1.

Figure 14:
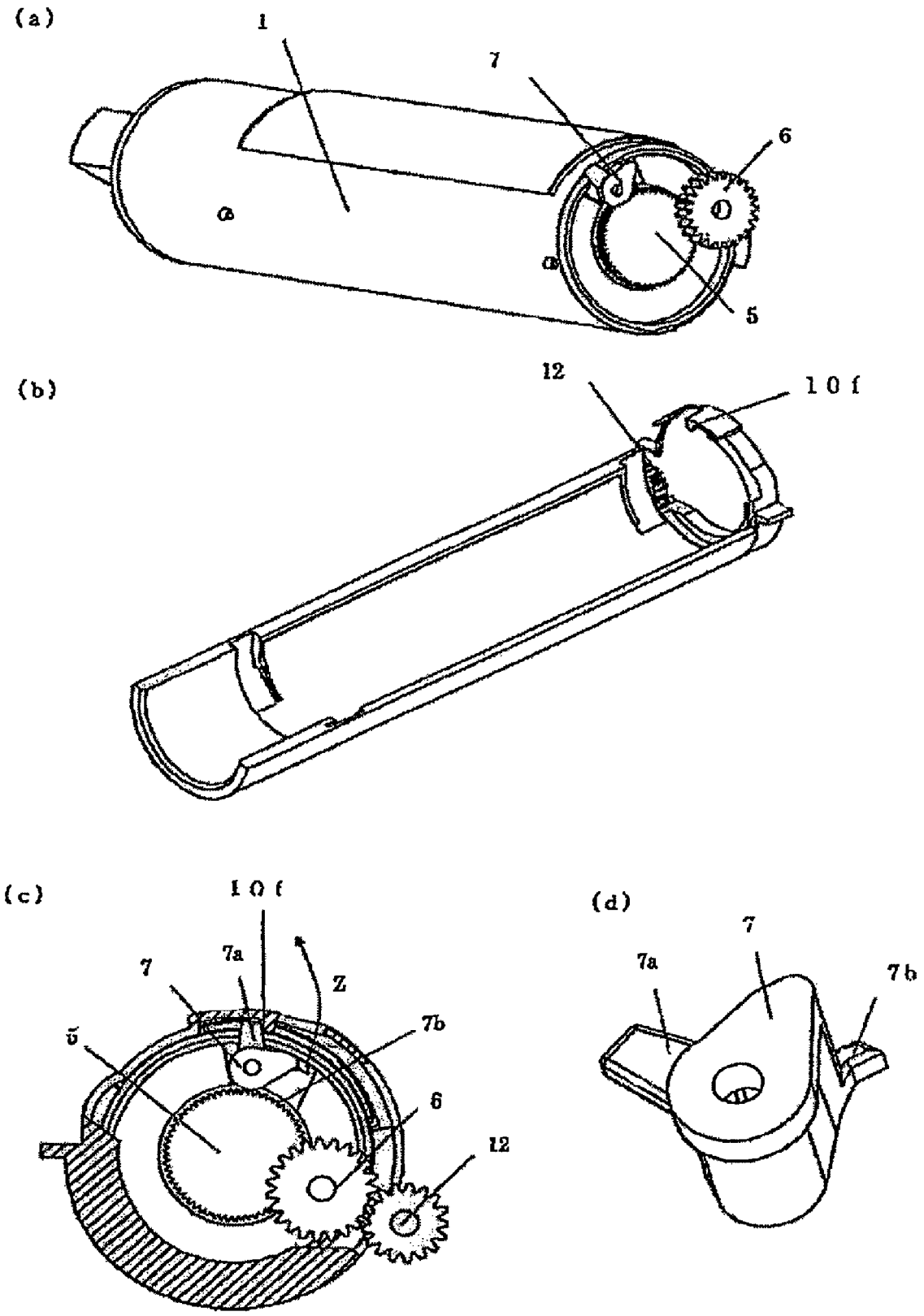
FIG. 14 is a perspective view of the developer supply container (a) according to the present invention, a perspective view (b) illustrating an inside of the developer receiving apparatus, a sectional view (c) illustrating a release state, and a perspective view (d) of a locking member.

Also in this embodiment, the first gear 5 is provided with the disengagement projection 5*a* for disengaging the locking member 9 from the locking member 7. However, the disengaging mechanism may be structured as shown in FIG. 14(*c*).

More concretely, the developer receiving device 10 is provided with a disengagement projection 10*f*, which is attached to such a portion of the developer receiving device 10 that after the rotation of the developer supply container 1 into its operative position, the disengagement projection 10*f* is in the position in which it acts on (disengages) the disengaging portion 7*a* of the locking member 7.

That is, at the same time as the rotation of the container body 1*a* causes the developer discharge opening 1*b* and developer receiving opening 10*b* to align with each other, the disengaging portion 7*a* of the locking member 7 collides with the disengagement projection 10*f* of the developer receiving device 10, and is pushed in the direction indicated by an arrow mark Z. As a result, the first gear 5 is released from the rotational load.

However, in the case of a modification of this embodiment such as the above described one, the timing with which the developer discharge opening 1*b* becomes aligned with the developer receiving opening 10*b* sometime does not synchronize with the timing with which the disengaging portion 7*a* of the locking member 7 becomes disengaged, for the following reason. That is, there are errors in the measurements and positioning of the various components of the developer supply container 1 and developer receiving device 10, and therefore, it is possible that the two timings do not synchronize. Thus, in the case of a modification of this embodiment, such as the above described one, it is possible that the locking member 7 is disengaged before the developer discharge opening 1*b* completely aligns with the developer receiving opening 10*b*. Therefore, the structural arrangement in this embodiment, which is less likely to allow the above described problem to occur, is preferable.

(Operation for Setting up Developer Supply Container)

Figure 7:
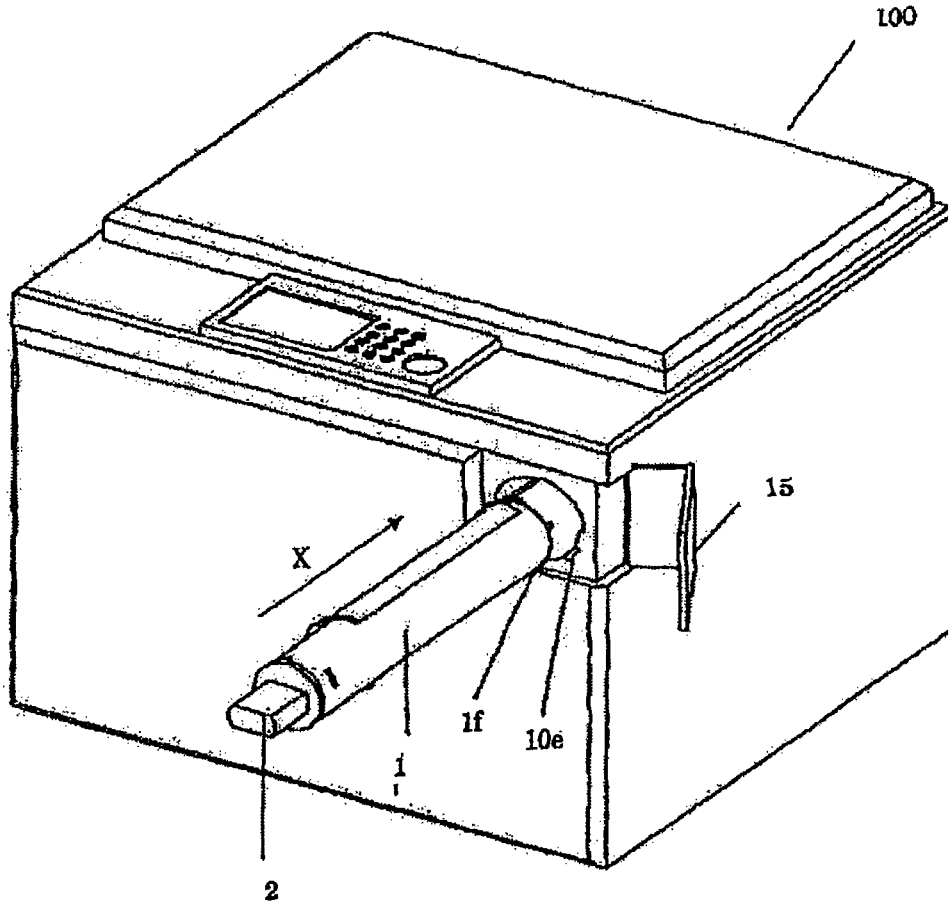
FIG. 7 is a perspective view illustrating a state when the development supply container is mounted to the developer receiving apparatus.
Figure 8:
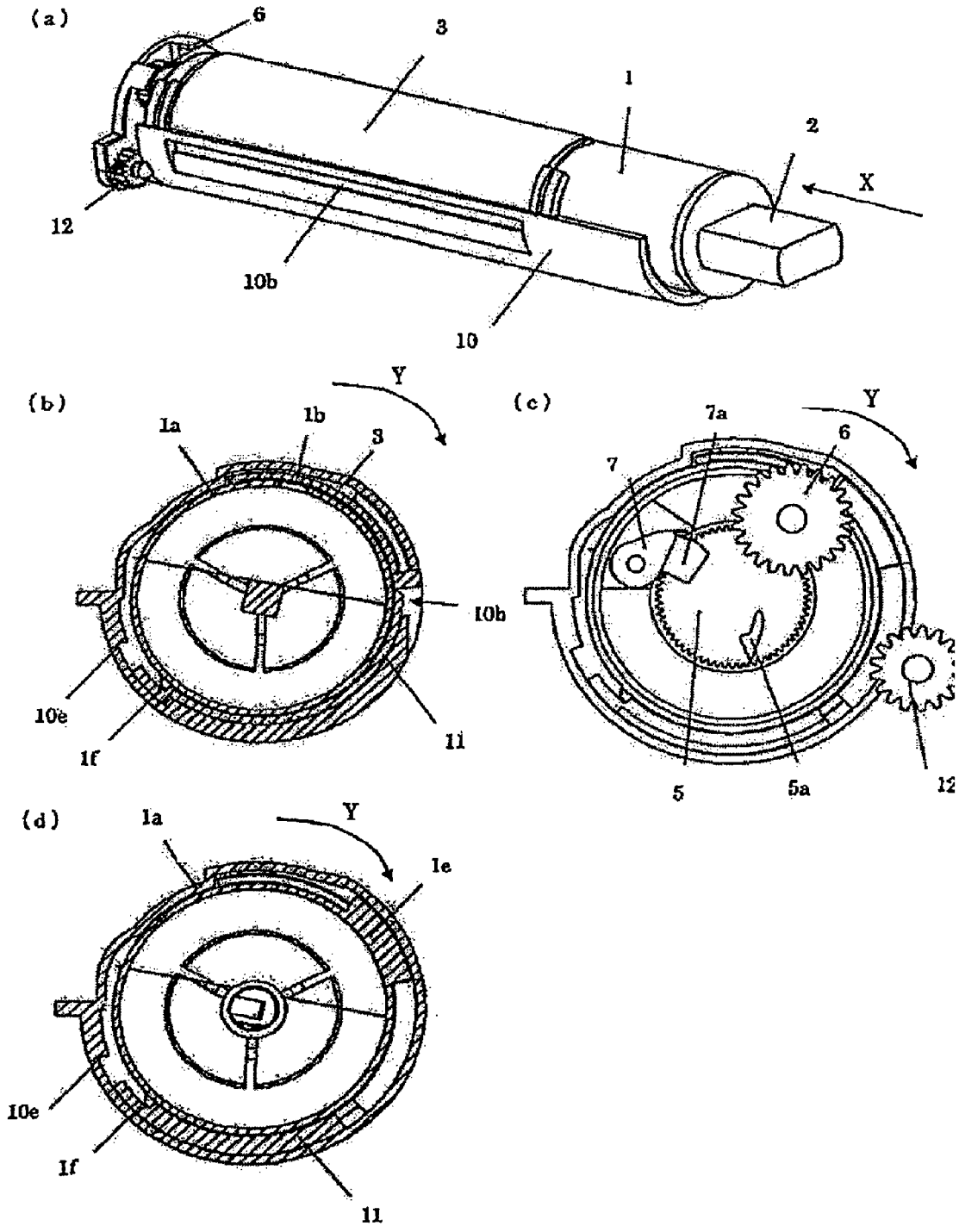
FIG. 8 illustrates a state after the developer supply container is mounted to the developer receiving apparatus, wherein (a) is a perspective view, and (b)-(d) are sectional side views.

Next, referring to FIGS. 7-9, the operation for setting up the developer supply container 1 will be described. FIGS. 8(*b*) and 9(*b*) are sectional views of the developer supply container 1 and developer receiving device 10, which are for describing the relationship among the developer discharge opening 1*b*, developer receiving opening 10*b*, and developing device shutter 11. FIGS. 8(*c*) and 9(*c*) are sectional views of the developer supply container 1 and developer receiving device 10, which are for describing the relationship among the driving gear member 12, first gear 5, and second gear 6. FIGS. 8(*d*) and 9(*d*) are sectional views of the developer supply container 1 and developer receiving device 10, which are for describing primarily the relationship among the developing device shutter 11 and the portions of the container body 1*a*, which move with the developing device shutter 11.

The abovementioned operation for setting up the developer supply container 1 is the operation for rotating the developer supply container 1, which is in its mounting and dismounting position in the developer receiving device 10, by the preset angle in order to rotate the developer supply container 1 into its operative position. The abovementioned mounting and dismounting position is the position in the developer receiving device 10, into which the developer supply container 10 is mountable, and from which the developer supply container 1 is removable from the developer receiving device 10. Further, the operative position means the refilling position (set position), or the position which enables the developer supply container 1 to carrying out the operation for refilling the developing device with developer (operation for discharging developer into developer receiving device 10). As the developer supply container 1 is rotated slightly from the abovementioned mounting and dismounting position, a locking mechanism is activated to preventing developer supply container 1 from being removed from the developer receiving device 10; once the developer supply container 1 is rotated beyond this point, the developer supply container 1 cannot be removed from the developer receiving device 10. In other words, while the developer supply container 1 is in the abovementioned operative position, the developer supply container 1 cannot be removed from the developer receiving device 10.

Next, the steps in the operation for setting up the developer supply container 1 will be sequentially described.

(1) A user is to open the cover 15 for the developer receiving device 10, and insert the developer supply container 1 into the developer receiving device 10 in the direction indicated by an arrow mark X in FIG. 8(*a*), through the opening of the developer receiving device 10, which was exposed by the opening of the cover 15. In this step, there is a certain amount of distance between the driving gear member 12 of the developer receiving device 10 and the second gear 6 of the developer supply container 1, making it impossible for driving force to be transmitted from the driving gear member 12 to the second gear 6, as shown in FIG. 8(*c*).

(2) After the mounting of the developer supply container 1 into the developer receiving device 10, the user is to rotate the handle 2 in the direction (opposite direction from rotation direction of conveying member) indicated by an arrow mark Y in FIGS. 8(*b*), 8(*c*), and 8(*d*). As the handle 2 is rotated, the developer supply container 1 becomes connected to the developer receiving device 10 so that the driving force can be transmitted from the developer receiving device 10 to the developer supply container 1.

Figure 10:
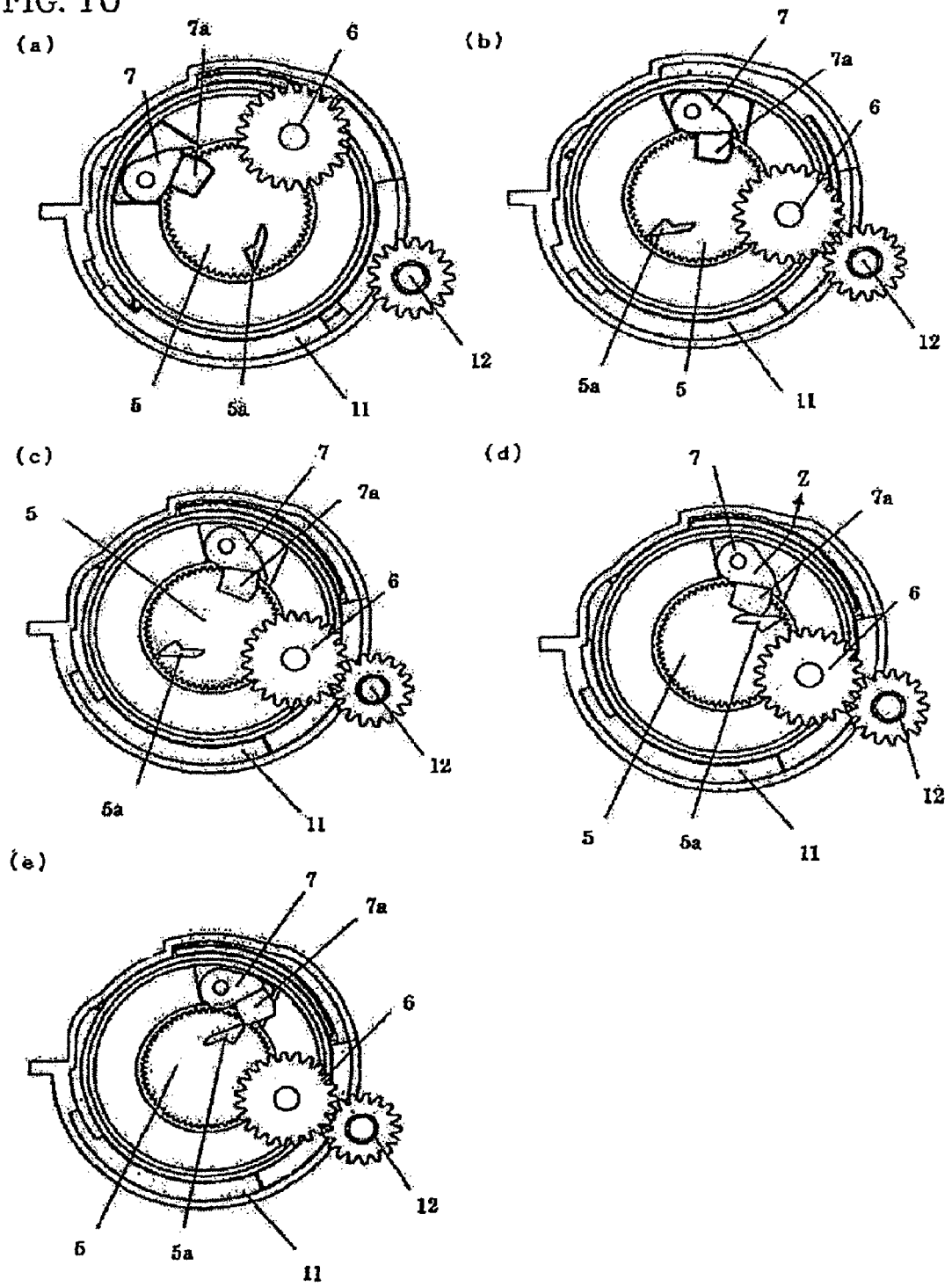
FIG. 10 illustrates the developer supply container according to the present invention, wherein (a) is a side view after the mounting, (b) is a side view after the completion of drive connection, and (c)-(e) are side views after completion of the rotation.

To describe in more detail, as the container body 1*a* rotates from a mounting position as shown in FIG. 10 (*a*), the second gear 6 orbitally rotates about the rotational axis of the developer supply container 1 (which coincides with rotational axis of conveying member), and engages with the driving gear member 12, making it possible for the driving force to be transmitted from the driving gear member 12 to the second gear 6 after this point in time of engagement between the driving gear member 12 and second gear 6.

FIG. 10(*b*) shows the developer supply container 1 which has been rotated by the preset angle by the user. When the developer supply container 1 is in the condition shown in FIG. 10(*b*), the developer discharge opening 1*b* is practically entirely covered with the container shutter 3 (leading edge of developer discharge opening 1*b* is opposing container shutter stopper portion 10*d* of developer receiving device 10). The developer receiving opening 10*b* is also completely closed by the developing device shutter 11, making it impossible for the developer receiving device 10 from being supplied with developer.

(3) The user is to close the cover 15 for exchanging the developer supply container 1.

(4) As the cover 15 is closed, the driving force from the driving motor is inputted into the driving gear member 12.

As the driving force is inputted into the driving gear member 12, the developer supply container 1 automatically rotates toward its operative position (refilling position), because the rotational load of the second gear 6 which is in mesh with the driving gear member 12 is being kept at a higher level by the torque generating mechanism through the first gear 5.

In this embodiment, incidentally, the amount of the rotational force which is generated in the developer supply container 1 using the drive transmitting means is set to be greater than the amount of the rotational resistance (friction) which the developer supply container 1 receives from the developer receiving device 10. Therefore, the developer supply container 1 automatically and properly rotates.

Further, in this step, the operation for rotating the developer supply container 1 and the operation for opening the developing device shutter 11 are coordinately carried out by the unsealing projection 1*e*. More concretely, as the container body 1*a* is rotated, the developing device shutter 11 is pushed down by the unsealing projection 1*e* of the developer supply container 1, being thereby slid in the direction to unseal the developer receiving opening 10*b*. As a result, the developer receiving opening 10*b* is unsealed (FIGS. 8(*d*)-9(*d*)).

On the other hand, the unsealing movement of the developing device shutter 11, which is caused by the rotation of the container body 1*a*, the container shutter 3 collides with the engaging portion of the developer receiving device 10, being thereby preventing from rotating further. As a result, the developer discharge opening 1*b* is unsealed.

As a result, the developer discharge opening 1*b*, which has become exposed due to the movement of the container shutter 3, directly opposes the developer receiving opening 10*b*, which has become exposed due to the movement of the developing device shutter 11; the developer discharge opening 1*b* and developer receiving opening 10*b* become connected to each other (8(*b*)-9(*b*)).

Figure 9:
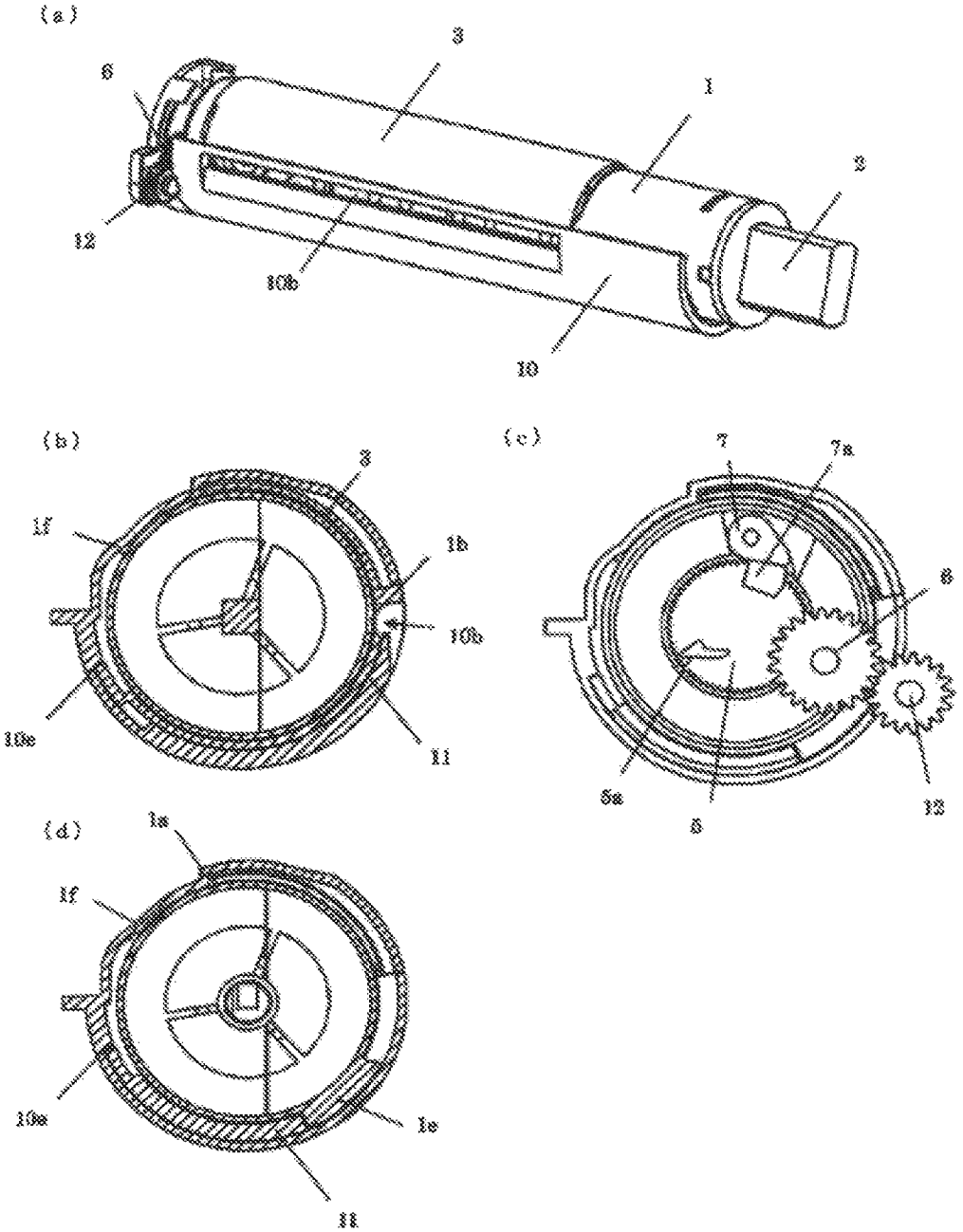
FIG. 9 illustrates a state after completion of container rotation after the developer supply container according to the present invention is mounted to the developer receiving apparatus, wherein (a) is a perspective view, and (b)-(d) are sectional side views.

The developing device shutter 11 stops (FIG. 10(*c*)) as it collides with the stopper 10*e* (FIG. 9(*b*)) for regulating the developing device shutter 11 in terms of the point at which the unsealing movement of the developing device shutter 11 is ended. Therefore, the bottom edge of the developer receiving opening 10*b* precisely aligns with the top edge of the developing device shutter 11. Incidentally, the automatic rotation of the developer supply container 1 ends in coordination with the ending of the unsealing movement of the developing device shutter 11 which is in connection to the developer supply container 1.

Incidentally, in this embodiment, in order to ensure that the developer discharge opening 1*b* becomes precisely aligned with the developer receiving opening 10*b* at the exact point in time when the developer supply container 1 reaches its operative position, the position of the developer discharge opening 1*b* relative to the container body 1*a* is adjusted (in terms of the circumferential direction of the container body 1*a*).

(5) The process of inputting driving force into the driving gear member 12 is continued. In this step, the developer supply container 1, which is in its operative position, is prevented from rotating further, through the developing device shutter 11. Thus, as the driving force is inputted to the driving gear member 12, the first gear 5 begins to rotate, against the rotational load generated by the torque generating mechanism, relative to the developer supply container 1, which is prevented from rotating. As a result, the disengagement projection 5*a* of the first gear 5 collides with the disengaging portion 7*a* of the locking member 7 (FIG. 10(*d*)). Then, as the first gear 5 rotates further, the disengagement projection 5*a* pushes up the disengagement portion 7*a* in the direction indicated by an arrow mark Z (FIG. 10(*e*)). As a result, the engaging portion 7*b* of the locking member 7 becomes disengaged (unhooked) from the catching portion 9*a* of the locking member 9 (FIG. 13(*b*)).

As a result, the rotational load which has been borne by the first gear 5 becomes substantially small.

Thus, the amount of force required to rotate the drive transmitting means (first-third gears) by the developer receiving device 10 (driving gear member 12) in the immediately following process, that is, the process for supplying the developer receiving device 10 with developer, is small. Therefore, the driving gear member 12 is not subjected to a large amount of rotational load, and therefore, can reliably transmit driving force.

Also in this embodiment, the developer supply container 1 and developer receiving device 10 are structured so that a certain length of time is provided between when the automatic rotation of the developer supply container 1, which aligns the developer discharge opening 1*b* with the developer receiving opening 10*b*, ends, and when the rotational load borne by the first gear 5 is removed. In other words, it is ensured that the developer discharge opening 1*b* and developer receiving opening 10*b* are properly aligned with each other.

Incidentally, if the rotational load applied to the drive transmitting means is not changed (switched), that is, maintained at the same level, it is possible that the following problems will occur. Therefore, the structural arrangement in this embodiment, which changes (switches) the rotational load, is preferable.

That is, in the case of the structural arrangement, in which the amount of the rotational load is kept at the same level, the first gear 5 remains under the influence of the torque generating mechanism for a long time even after the developer discharge opening 1*b* aligns with the developer receiving opening 10*b* and the rotation of the developer supply container 1 ends. Therefore, the rotational load continuously applies to the driving gear member 12 through the second gear 6, possibly affecting the durability of the driving gear member 12, reliability of the driving gear member 12 in terms of driving force transmission, etc. It is also possible that the ring 14 will be excessively heated by the rotational friction, which lasts a substantial length of time, and this heat will deteriorate the drive transmitting means, and the developer in the developer supply container 1.

In comparison, in the case of the structural arrangement in this embodiment, it is possible to reduce the amount of the electric power which is required to drive the drive transmitting means by the developer receiving device 10. Further, it is unnecessary to increase in strength and durability of the components, for example, the driving gear member 12 to begin with, of the gear train of the developer receiving device 10 beyond the ordinary levels. Therefore, this embodiment can contribute to the cost reduction for the developer receiving device 10, and also, can prevent the drive transmitting means and developer from being thermally deteriorated.

As described above, in this embodiment, the operation for properly positioning the developer supply container 1 to carrying out the process of supplying the developer receiving device 10 with developer is automated with the use of the simple structure and operation, that is, the structure and operation in which the driving force is inputted into the drive transmitting means of the developer supply container 1 from the developer receiving device 10.

That is, the developer supply container 1 can be automatically rotated to its operative position, with the use of the simple structural arrangement, that is, the structural arrangement in which instead of the provision of a combination of a driving motor and a gear train, which is separate from the combination of a driving motor and a gear train, which is for driving the developer conveying member 4, the drive transmitting means is utilized. Therefore, not only is the structural arrangement in this embodiment is superior in terms of the usability of the recording apparatus, but also, in terms of the process of supplying the developer receiving device 10 with developer.

Therefore, it can prevent the formation of defective images, such as an image which is nonuniform in image density and an image which is insufficient in density, which is attributable to the insufficiency in the amount by which the developing apparatus is supplied with developer.

In addition, the employment of the structural arrangement in this embodiment can prevent the problems, which are possible to occur to the structural arrangement in which the drive transmitting means is utilized to automatically rotate the developer supply container 1 into its operative position.

(Operation for Removing Developer Supply Container)

The operation for taking out the developer supply container 1, which is carried out for a certain reason, for example, for replacing the developer supply container 1, will be described.

(1) First, a user is to open the cover 15 (for replacing developer supply container 1).

(2) Then, the user is to rotate the developer supply container 1 from the operative position to the mounting and dismounting position by rotating the handle 2 in the opposite direction from the direction indicated by the arrow mark B in FIG. 8. As the handle 2 is rotated in the abovementioned direction, the developer supply container 1 is returned to the mounting and dismounting position, and the condition of the developer supply container 1 turns into the one shown in FIG. 8(*c*).

In this step, the developing device shutter 11 is moved again by being pushed up by the sealing projection 1*f* of the developer supply container 1, and the developer discharge opening 1*b* rotates, being thereby resealed by the container shutter 3 (FIG. 9(*b*)-FIG. 8(*b*)).

More concretely, the container shutter 3 collides with the stopper portion (unshown) of the developer receiving device 10, being thereby prevented from rotating further. Then, in this state, the developer supply container 1 is rotated further. As a result, the developer discharge opening 1*b* is resealed by the container shutter 3.

The rotation of the developer supply container 1, which is for closing the developing device shutter 11 is stopped by the abovementioned stopper portion (unshown), which is a part of the guiding portion 1*d* of the container shutter 3, as the stopper portion collides with the container shutter 3.

Further, the rotation of the developer supply container 1 causes the second gear 6 to disengage from the driving gear member 12. Thus, by the time when the developer supply container 1 rotates back into the mounting and dismounting position, the second gear 6 is in the position in which it does not interfere with the driving gear member 12.

(3) Lastly, the user is to take out the developer supply container 1, which is in the mounting and dismounting position in the developer receiving device 10, from the developer receiving device 10.

Thereafter, the user is to place a brand-new developer supply container (1) prepared in advance into the developer receiving device 10. This operation for mounting the brand-new developer supply container (1) is the same as the above described "Operation for Setting up Developer Supply Container".

(Principle of Rotation of Developer Supply Container)

Figure 12:
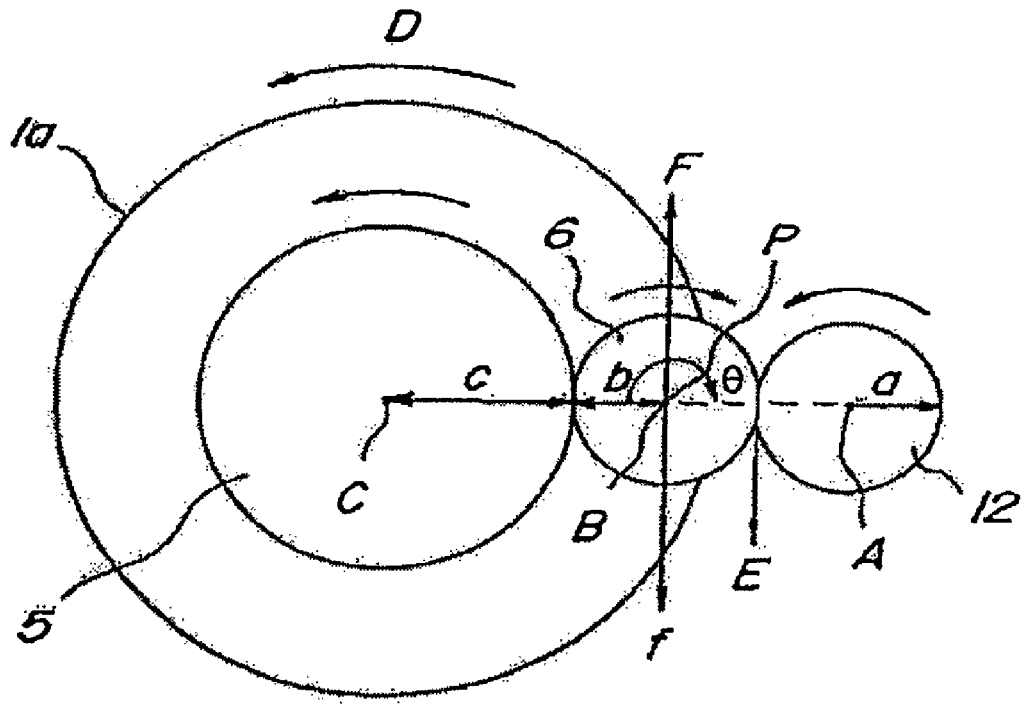
FIG. 12 shows a model for illustrating a pulling force in the present invention.

Next, referring to FIG. 12, the principle of the rotation of the developer supply container 1 will be described. FIG. 12 is a drawing for describing the principle of the automatic rotation of the developer supply container 1, which is caused by the pulling force.

As the second gear 6 receives the driving force from the driving gear member 12 while remaining in mesh with the driving gear member 12, the shaft portion P of the second gear 6 is subjected to a rotational force f as the second gear 6 is rotated. This rotational force f acts on the container body 1*a*. If the rotational force f is greater than the rotational resistive force F (friction to which developer supply container 1 is subjected as peripheral surface of developer supply container 1 slides against developer receiving device 10) which the developer supply container 1 receives from the developer receiving device 10, the container body 1*a* rotates.

Therefore, it is desired that the rotational load to which the second gear 6 is subjected relative to the developer supply container 1, as the torque generating mechanism is made to act on the first gear 5, is made to be greater than the rotational resistive force F which the developer supply container 1 receives from the developer receiving device 10.

On the other hand, it is desired that after the influence of the torque generating mechanism is removed, the rotation load of the second gear 6 relative to the developer supply container 1 be no greater than the amount of the rotational resistive force F which the developer supply container 1 receives from the developer receiving device 10.

It is desired that the above described relationship between the two forces in terms of magnitude holds for the duration between the point in time when the second gear 6 begins to mesh with the driving gear member 12, and the point in time when the developing device shutter 11 finishes completely unsealing the developer discharge opening 1*b*.

The value of the rotational force f can be obtained by measuring the amount of torque necessary to rotate (manually) the driving gear member 12 in the direction to open the development device shutter 11 while keeping the driving gear member 12 in mesh with the second gear 6, as will be described later. More concretely, a shaft or the like is connected to the rotational shaft of the driving gear member 12 so that its rotational axis aligns with that of the rotational axis of the rotational shaft of the driving gear member 12. The value of the rotational force f can be obtained by measuring the amount of the torque necessary to rotate this shaft with the use of a torque measuring device. The thus obtained amount of torque is the amount of rotational load obtained when there is no toner in the developer supply container 1.

The amount of the rotational resistive force F can be obtained by measuring the amount of rotational load at the rotation axis of the container body 1*a* while rotating (manually) the container body 1*a* in the direction to open the developing device shutter 11, as will be described later. This process of measuring the amount of the rotational resistive force F is to be carried out by rotating the container body 1*a* in the period between the point in time when the second gear 6 begins to mesh with the driving gear member 12 and the point in time when the developing device shutter 11 is completely shut. More concretely, the driving gear member 12 is removed from the developer receiving device 10, and a shaft or the like is attached to the container body 1*a* so that the rotational axis of this shaft or the like aligns with the rotational axis of the container body 1*a* and the shaft or the like rotates with the container body 1*a*. Thus, the amount of the rotational resistive force F can be obtained by measuring the amount of torque necessary to rotate this shaft with the use of a torque measuring device.

As the torque measuring device, a torque gauge (BTG90CM) made by TONICHI SEISAKUSHO Co., Ltd. was used. Incidentally, the amount of the rotational resistive force F may be automatically measured using a torque measuring device made up of a rotational motor and a torque converting device.

Next, referring to FIG. 12, the principle of the model shown in FIG. 12, will be described in detail. In the drawing, "a, b, and c" stand for the radii of the pitch circles of the driving gear member 12, second gear 6, and first gear 5, respectively. "A, B, and C" stand for the rotational loads of the driving gear member 12, second gear 6, and first gear 5 at their rotational axes, respectively (A, B, and C also designate the axial lines of these gears, respective, shown in FIG. 12). "E" stands for the force necessary to pull in the developer supply container 1 after the second gear 6 meshes with the driving gear member 12, and "D" stands for the resistive torque at the rotational axis of the container body 1*a*.

In order for the container body 1*a* to be rotated, $f>F$, and $F=D/(b+c)$, $f=(c+2b)/(c+b)\times E=(c+2b)/(c+b)\times(C/c+B/b)$, Therefore, $(c+2b)/(c+b)\times(C/c+B/b)>D/(b+c)$, and $(C/c+B/b)>D/(c+2b)$.

Therefore, in order to reliably generate the pulling force to rotate the developer supply container 1, it is desired that the formulas given above are satisfied. As the means for satisfying the formulas, it is possible to increase C or B, or reduce D.

That is, if the first gear 5 and second gear 6 are increased in the amount of the torque necessary to rotate them, while reducing the rotational resistance of the container body 1*a*, the container body 1*a* can be rotated.

In this embodiment, the objective of increasing the amount of the torque C, that is, the torque necessary to rotate second gear 6, is accomplished by increasing the amount of torque B, that is, the torque necessary to rotate the first gear 5, with the use of the above described torque generating mechanism. The torque B, that is, the torque necessary to rotate the first gear 5, is increased with the use of the above described torque generating mechanism, increasing consequentially the torque C, that is, the torque necessary to rotate the second gear 6.

In consideration of the fact that the developer supply container 1 is rotated by generating the pulling force, the greater the amount of torque necessary to rotate the first gear 5, the better. However, the increase in the mount of torque necessary to rotate the first gear 5 increases the amount of electric power consumed by the driving motor of the developer receiving device 10, and also, requires each gear to be increased in strength and durability. In other words, excessive increase in the amount of torque necessary to rotate the first gear 5 makes excessive the amount of electric power consumed by the driving motor of the developer receiving device 10, and requires each gear to be excessively increased in strength and durability. Further, the excessive increase in the amount of the torque necessary to rotate the first gear 5 is also undesirable in consideration of the effect of heat upon the developer. Therefore, it is desired that the ring 14 is adjusted in the amount of pressure it generates by being compressed by the inner circumferential surface 9*b* of the locking member 9 to optimize the amount of torque necessary to rotate the first gear 5. Further, the material for the ring 14 should be carefully selected to optimize the amount of torque necessary to rotate the first gear 5.

As for the rotational resistance which the developer supply container 1 receives from the developer receiving device 10 (friction between peripheral surface of developer supply container 1 and the developer supply container supporting surface of the developer receiving device 10), it is desired to be as small as possible. In this embodiment, in consideration of the concerns described above, such measures as making as small as possible the portion (peripheral surface) of the container body 1*a*, which will be in contact with the developer receiving device 10, and making as slippery as possible the sealing member, which is placed on the peripheral of the container body 1*a*, was taken.

Next, the method for setting the amount of torque necessary to rotate the second gear 6 will be concretely described.

It is desired that the value for the mount of torque required to rotate the second gear 6 is set in consideration of the amount of force necessary to be applied (at peripheral surface of developer supply container 1) to rotate the container body 1*a*, diameter of the developer supply container 1, and amount of eccentricity and diameter of the second gear 6. There is the following relationship among the amount of rotational resistance F' of the developer supply container 1, diameter D' of the developer supply container, amount of eccentricity e (distance between rotational axis of developer supply container 1 and point at which second gear 6 is supported by its rotational shaft), and diameter d' of the second gear 6:

Amount of torque necessary to rotate second gear 6=F'×d'×D'/(2×(2e+d')).

The rotational resistance F' of the developer supply container 1 is affected by the diameter of the developer supply container 1, size of sealing surface of the sealing member, and structure of sealing member. However, it is reasonable to think that an ordinary developer supply container is roughly 30 mm-200 mm in diameter. Accordingly, the rotational resistance F' is set to a value within the range of 1 N-200 N. Further, in consideration of the diameter of the developer supply container 1, the diameter d' and amount of eccentricity e of the second gear 6 should be in the range of 4 mm-100 mm, and the range of 4 mm-100 mm, respectively. Needless to say, optimal values are to be selected according to the size and specifications of an image forming apparatus. Thus, in the case of an ordinary developer supply container 1, the amount of torque required to rotate the second gear 6 is set to a value within the range of $3.0\times10^{-4}$ N·m-18.5 N·m, in consideration of the MIN and MAX of the abovementioned ranges.

For example, it is reasonable to think that if a developer supply container such as the above described one is 60 mm in diameter, the rotational resistance F' is no less than roughly 5 N and no more than 100 N, in consideration of the nonuniformity in the seal structure or the like.

Therefore, if the amount of eccentricity and diameter of second gear 6 are 20 mm and 20 mm, respectively, in this embodiment, it is desired that the amount of torque required to rotate the second gear 6 is set to be no less than 0.05 N·m and no more than 1 N·m, in consideration of the rotational resistance F'. Further, in consideration of various losses, the amount of deviation in the measurements of the components, margin of safety, etc., which will be described later, the top limit value is desired to be roughly 0.5 N·m in consideration of the strength of the torque generating mechanism of the developer supply container 1. That is, the amount of torque required to rotate the second gear 6 is set to be no less than 0.1 N·m and no more than 0.5 N·m.

In this embodiment, the image forming apparatus is structured so that the rotational load for the second gear 6, including the amount (roughly 0.05 N·m) of torque necessary to stir the developer in the developer supply container 1, is set to be no less than 0.15 N·m and no more than 0.34 N·m, in consideration of the nonuniformity in the various components. However, the amount of torque necessary to stir the developer is affected by the amount of developer in the developer supply container 1 and the structural setup for stirring the developer. Therefore, the rotational load for the second gear 6 should be set in anticipation of this change.

Further, after the automatic rotation of the developer supply container 1, the locking member 7 is disengaged, and therefore, the contribution of the torque generating mechanism to the rotational load for the second gear 6 becomes zero. At this point, the amount of torque necessary to drive the developer supply container 1 is roughly equal to the amount of torque necessary to stir the developer.

In this embodiment, after the disengagement of the locking mechanism, the rotational load of the second gear 6 is roughly 0.05 N m, which is the same as the amount of torque necessary to rotate the conveying member 4 to stir the developer.

In consideration of the amount of load to which the developer supply container 1 is subjected and the amount of power consumption, the amount of this torque necessary to rotate the second gear 6 after the disengagement of the locking mechanism is desired to be as small as possible. Further, assuming that an image forming apparatus is structured as in this embodiment, if the amount by which the torque generating mechanism contributes to the rotational load of the second gear 6 is no less than 0.005 N·m after the disengagement of the locking mechanism, heat is generated in the torque generating portion, and as this heat accumulates, it is possible that it will affect the developer in the developer supply container 1 by transmitting thereto.

Therefore, it is desired that an image forming apparatus be structured so that the amount by which the torque generating mechanism contributes to the rotational load of the second gear 6 after the disengagement of the torque generating means is no more than 0.005 N·m.

Further, it is important to take into consideration as one of the important factors, the direction of the force E which is generated as the second gear 6 receives rotational force from the driving gear member 12.

Referring to FIG. 12, this factor will be concretely described. The amount f of the rotational force generated in the shaft portion of the second gear 6 is equivalent to a component of the amount of the force F which the second gear 6 receives from the driving gear member 12. Therefore, it is possible that the rotational force f will not be generated, because of the positional relationship between the second gear 6 and driving gear member 12. In the case of the model shown in FIG. 12, the straight line connecting the point C, or the rotational axis of the container body 1*a* (which in this embodiment coincides with rotational axis of first gear 5), and the point B, or the rotational axis of the second gear 6, is the referential line. It is desired that the image forming apparatus be structured so that the angle θ (clockwise angle relative to referential line 0°)) between this referential line and the straight line connecting the point B, and the point A, or the rotational axis of the driving gear member 12, is no less than 90° and no more than 250°.

In particular, it is desired that the f component (component generated at the contact point between the second gear 6 and driving gear member 12, and parallel to line tangential to container body 1*a*) of the force E generated by the meshing between the second gear 6 and driving gear member 12 be efficiently utilized. Thus, the angle θ is desired to be set to be no less than 120° and no more than 240°. Incidentally, from the standpoint of more effectively utilize the component f of the force E, the angle θ is desired to be set to be close to 180°. In this model, it is 180°.

In this embodiment, each of the abovementioned gears was positioned in consideration of the above described factors.

In reality, a certain amount of force is lost when driving force is transmitted from one gear to another. However, this model was described ignoring these losses. Thus, in reality, the developer supplying container and the components related thereto should be structured in consideration of these losses so that the developer supply container is automatically and properly rotated, which is needless to say.

In the first embodiment described above, the first and second gears 5 and 6 are used as the means for transmitting rotational force. Therefore, driving force can be reliably transmitted in spite of the simplicity in the driving force transmitting structure.

The developer supply container 1 in this embodiment was tested for the replenishment performance, and there was no problem regarding the developer replenishment; the image forming apparatus was reliably supplied with developer, and therefore, satisfactory images were continuously formed.

The structure of the developer receiving device does not need to be limited to the above described one. For example, the developer receiving device may be structured so that it can be removably mountable in an image forming apparatus, that is, it may be structured as an image formation unit. As the examples of an image formation unit, a process cartridge having image forming processing means, such as a photosensitive member, a charging device, a cleaner, etc., a development cartridge having a developing device such as a development roller, can be listed.

Figure 20:
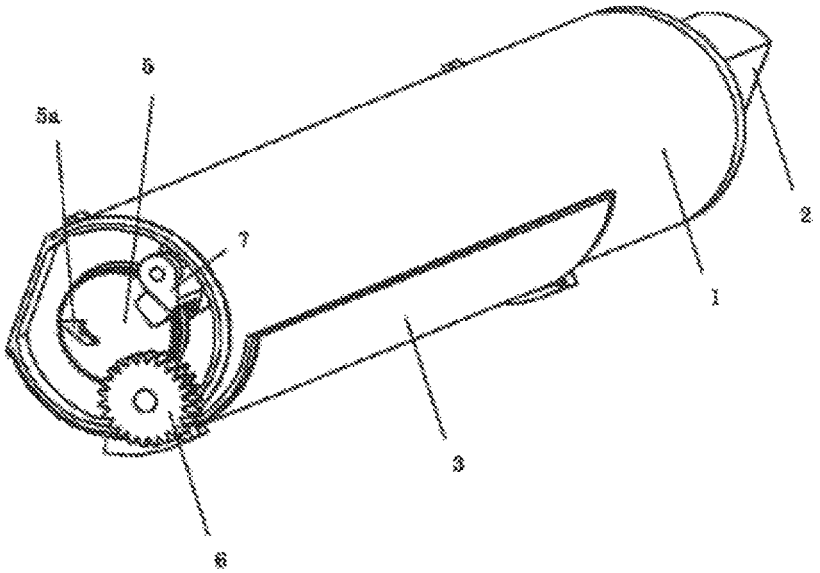
FIG. 20 is a perspective view illustrating a developer supply container according to the present invention.

In this embodiment, the container body of the developer supply container is cylindrical. However, the shape of the container body does not need to be limited to the cylindrical one. For example, the container body of the developer supply container may be shaped as shown in FIG. 20, in which the cross section of the container body appears as if a small segment has been cut away from a circle. In such a case, the rotational axis of the developer supply container coincides with the center of the arc of the cross section near the developer discharge opening, which also roughly coincides with the rotational axis of each of the abovementioned shutters.

The material for each of the abovementioned components, the method for forming each of the components, the shape of each component, etc., do not need to be limited to those mentioned above. They are optional; they can be modified within a range in which Embodiment 2

Embodiment 2 will be described. This example is different from embodiment 1 in the structure of a driver transmission means for the developer supply container. The other structures of this embodiment are similar to those of embodiment 1, and therefore, the detailed description thereof is omitted.

Figure 16:
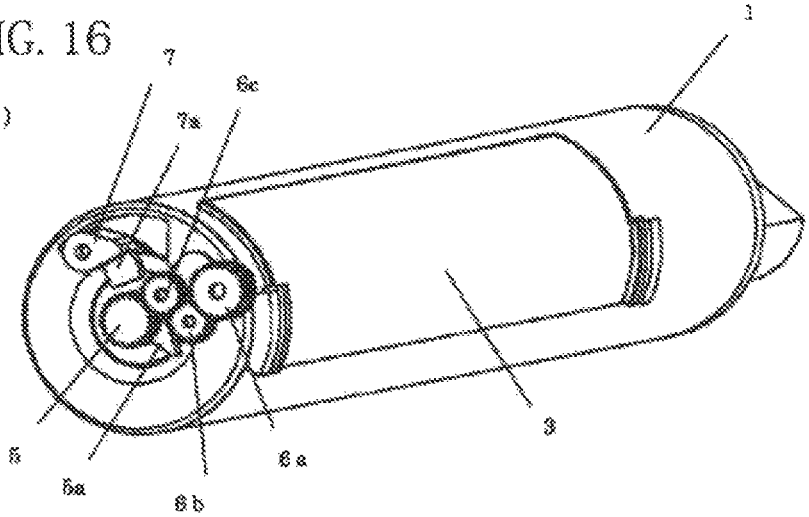
FIG. 16 is a perspective view (a) illustrating a developer supply container according to the present invention, and a side view (b).
Figure 16:
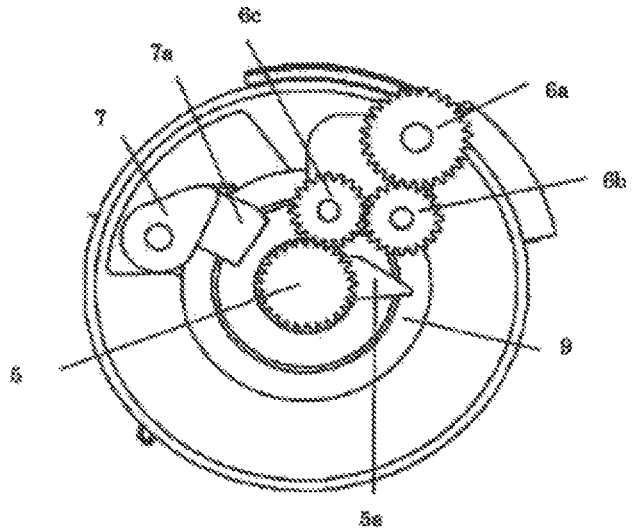

Referring to FIG. 16, in this embodiment, the image forming apparatus is structured so that four gears 5, 6*a*, 6*b*, and 6*c* are used to transmit driving force to the conveying member 4.

The number of the gears for transmitting driving force to the first gear 5 is an odd number, and the rotational direction of the gear 6*a*, which is in mesh with the driving gear member 12, is the same as the direction in which the developer supply container 1 is automatically rotated.

Even if the image forming apparatus is structured as in this embodiment, the force which automatically rotated the container body 1*a* through the gear 6*a* as driving force is inputted into the driving gear member 12 which is in mesh with the gear 6*a*, can be generated as in the first embodiment.

Using multiple gears to transmit driving gear to the second gear 6 results in cost increase. Thus, it is desired that the gears 6*a*, 6*b*, and 6*c* are made interchangeable.

From the standpoint of preventing cost increase, the first embodiment is preferable.

Embodiment 3

Embodiment 3 will be described. This example is different from embodiment 1 in the structure of a driver transmission means for the developer supply container. The other structures of this embodiment are similar to those of embodiment 1, and therefore, the detailed description thereof is omitted.

Figure 17:
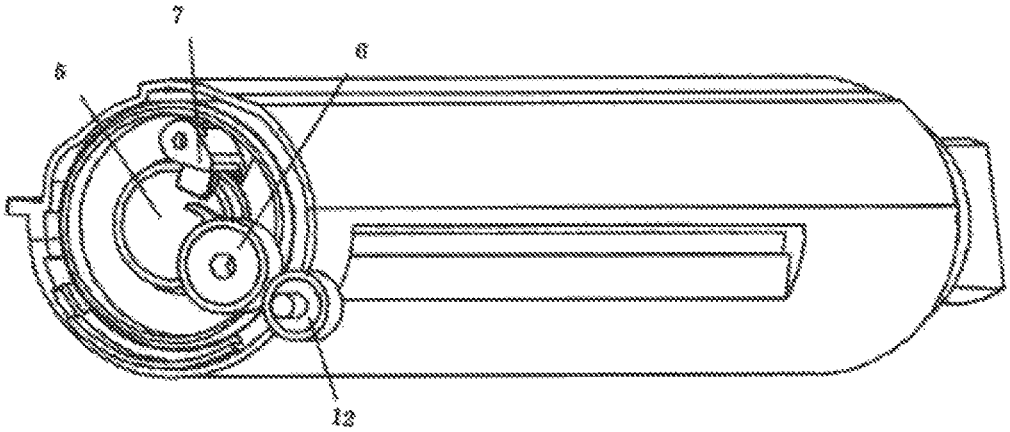
FIG. 17 is a perspective view illustrating a developer supply container according to the present invention.

Referring to FIG. 17, in this embodiment, a first friction wheel 5, a second friction wheel 6, and a third friction wheel are employed as the drive transmitting means. Each friction wheel is formed of a substance which is high in friction, so that the friction wheel is substantial in the friction of its peripheral surface, or the contact surface. The third friction wheel is an integral part of the second friction wheel 6 and is coaxial with the second friction wheel 6. Further, the driving gear member 12 of the developer receiving device is also a friction wheel.

Even in the case of the structure, such as the above described, the developer supply container can be automatically rotated as in the first embodiment.

From the standpoint of properly transmitting driving force, the structure, such as the one in the first embodiment, which employs a drive transmitting means made up of components having teeth, is preferable.

Embodiment 4

Embodiment 4 will be described. This example is different from embodiment 1 in the structure of a driver transmission means for the developer supply container. The other structures of this embodiment are similar to those of embodiment 1, and therefore, the detailed description thereof is omitted.

Figure 22:
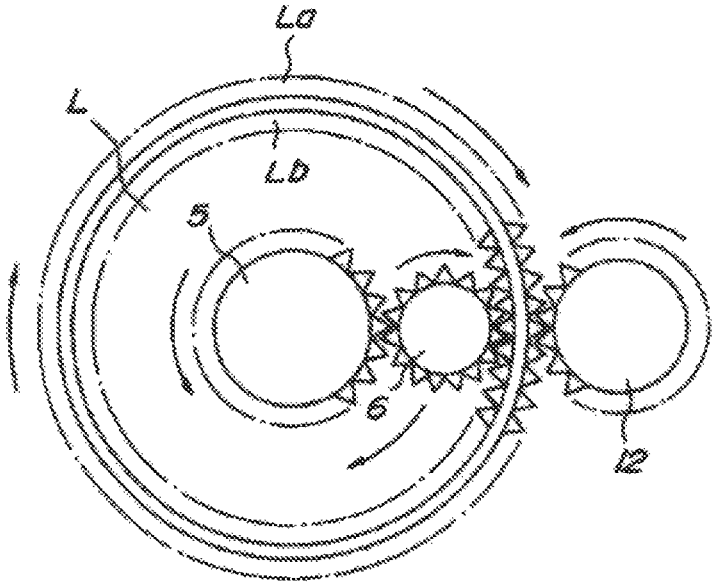
FIG. 22 is a sectional side view illustrating a state of a drive connecting portion of the developer supply container, including a large gear.

Referring to FIG. 22, this embodiment is different from the first embodiment in that the structure in this embodiment is provided with a large gear L, that is, an additional gear, as one of the driving force transmitting members, which meshes with the driving gear member 12 of the developer receiving device 10.

FIG. 22 is schematic sectional view of the driving force transmitting portion of the developer supply container, which shows how the gears are in mesh among them to transmit driving force. Although some of the gears in the drawing appear as if they do not have a full circle of teeth, they actually have a full circle of teeth.

Not only does the large gear L have external teeth La, or the teeth on the outer side of the gear, which mesh with the driving gear member 12, but also, internal teeth Lb, or the teeth on the inward side of the gear, which mesh with the second gear 6. It is rotatably attached to the container body 1*a*.

More concretely, the large gear L is attached after the first and second gears 5 and 6 are attached. In other words, it is attached to one of the end walls of the container body 1*a*. In order to make it easier to understand how driving force is transmitted, FIG. 22 was drawn to show the inward side of the large gear L, showing the manner in which the gears are in mesh among themselves, and the directions in which the gears rotate.

In this embodiment, because of the employment of the large gear L, the developer supply container 1 and developer receiving device 10 become connected, in terms of driving force transmission, at the end of the process of inserting (mounting) the developer supply container 1 into the developer receiving device 10.

Therefore, all that is necessary to be done by the user at the completion of the process of inserting (mounting) the developer supply container 1 is to close the cover for mounting or removing the developer supply container.

Thereafter, as driving force is inputted into the driving gear member 12, the large gear L rotated in the opposite direction from the rotational direction of the driving gear member 12, and therefore, the second gear 6, which is in mesh with the inward teeth of the large gear L rotates in the same direction as the rotational direction of the large gear L. Therefore, the developer supply container 1 automatically rotates from the mounting and dismounting position to the operative position, based on the same principle as the principle based on which the developer supply container 1 automatically rotates in the first embodiment. As a result, the opening of the developing device shutter 11 and the alignment between the developer discharge opening 1*b* and developer receiving opening 10*b* coordinately occur.

Further, if it is necessary to remove the developer supply container 1, all that is necessary is to input into the driving gear member 12 such driving force that is opposite in direction from the driving force inputted to unsealing the developer supply container 1. As such driving force is inputted, the developer supply container 1 is automatically rotated from the operative position to the mounting and dismounting position, and therefore, the process of closing the developing device shutter 11 and the process of closing the container shutter 3 are coordinately carried out.

As will be evident from the description of this embodiment given above, the structural arrangement in this embodiment is superior in terms of usability.

Embodiment 5

Figure 23:
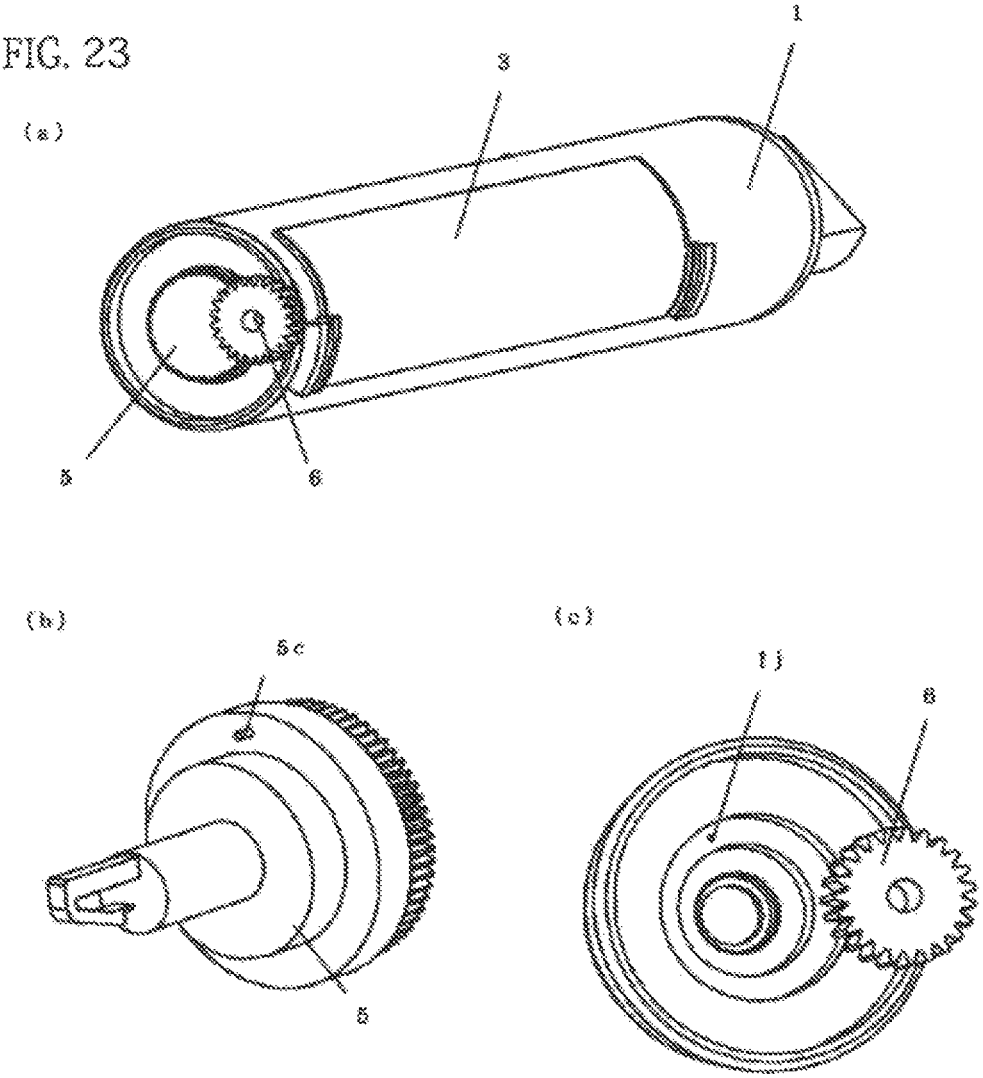
FIG. 23 is a perspective view (a) of the developer supply container according to the present invention, perspective view (b) illustrating a structure for load switching, and a perspective view (c) illustrating a structure for the load switching.

Referring to FIG. 23, a developer supply container 1 according to embodiment 5 will be described. The structure of the container of this embodiment is fundamentally the same as that of embodiment 1, and therefore, the description will be made as to the structure different from that of embodiment 1. The same reference numerals are assigned to the elements having the corresponding functions.

The developer supply container 1 in this embodiment is different in torque generating mechanism from the developer supply container 1 in the first embodiment.

More concretely, the first gear 5 is provided with a projection 5*d* as a suppressing means (rotational load switching means), whereas the container body 1*a* is provided with a hole 1*j* as a suppressing means (rotational load switching means). The projection 5*d* is on the side of the first gear 5, which contacts the container body 1*a*, and the hole 1*j* is on the side of the container body 1*a*, which contacts the first gear 5.

When the first gear 5 is attached to the container body 1*a*, the projection 5*c* is to be inserted into the hold 1*j* to lock the first gear 5 to the container body 1*a*.

Therefore, the first gear 5 is prevented from rotating relative to the container body 1*a*. In this embodiment, this structural arrangement is employed to automatically rotate the developer supply container 1.

Further, in the case of this structural arrangement, driving force is continuously inputted into the driving gear member 12 even after the completion of the automatic rotation of the developer supply container 1. Thus, the strength of the projection 5*c* is set so that the projection 5*c* will be broken by the driving force inputted to the driving gear member 12 after the completion of the automatic rotation of the developer supply container 1. Thus, after the completion of the automatic rotation of the developer supply container 1, the projection 5*c* is broken, allowing thereby the first gear 5 to rotate relative to the container body 1*a*.

Incidentally, in this embodiment, the rotational load for the second gear 6 is set to 0.3 N·m, and the projection 5*c* is designed so that it breaks off as the amount of torque transmitted to the second gear 6 reaches 0.6 N·m.

In the case of the structural arrangement in this embodiment, not only can the same effects as those obtained in the first embodiment be obtained, but also, the components, such as the locking member 7, locking member 9, ring 14 which are employed in the first embodiment, are unnecessary, making it possible to reduce the cost of the developer supply container 1.

However, the structural arrangement in this embodiment is such that the rotational load for the first gear 5 is eliminated by breaking off the projection 5*c* of the first gear 5. Therefore, it is possible that after the projection 5*c* is broken off (separated from developer supply container 1), it will fall into the developer receiving device 10. Therefore, the structural arrangement in the first embodiment, which does not have such a possibility, is preferable.

Incidentally, the mechanism employed as the torque generating mechanism does not need to be limited to the mechanism in the preceding embodiments. For example, the rotational load may be created by locking the drive transmitting means (first and second gears 5 and 6) to the container body 1*a* with the use of a piece of adhesive tape, a small amount of adhesive, etc. In such a case, as the amount of load to which the abovementioned piece of adhesive tape or small amount of adhesive is subjected exceeds a preset value after the completion of the automatic rotation of the developer supply container 1, the drive transmitting means (first and second gears 5 and 6) are released from the container body 1*a*, as in the preceding embodiments. Incidentally, in consideration of the reliability in the generation and elimination of the rotational load, the structural arrangement in the first embodiment is preferable to those in these modifications.

Figure 25:
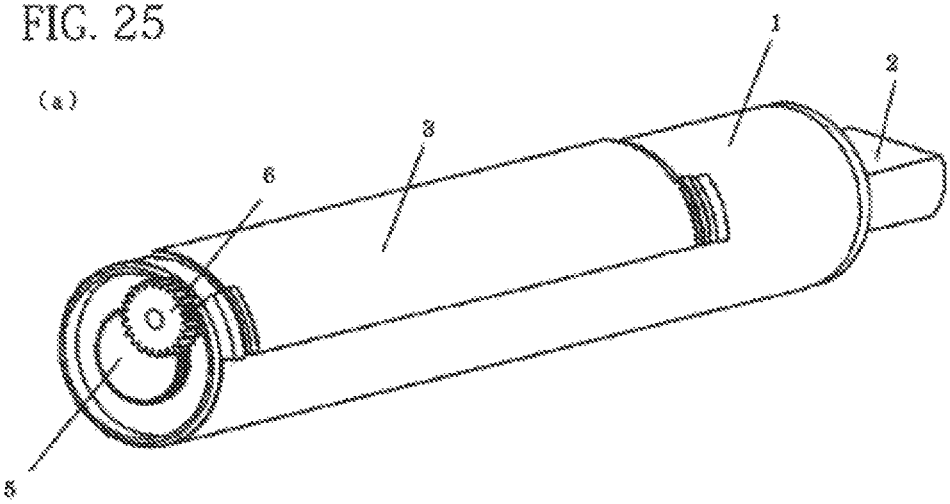
FIG. 25 is a perspective view (a) of the developer supply container according to the present invention and a sectional side view (b) thereof.
Figure 25:
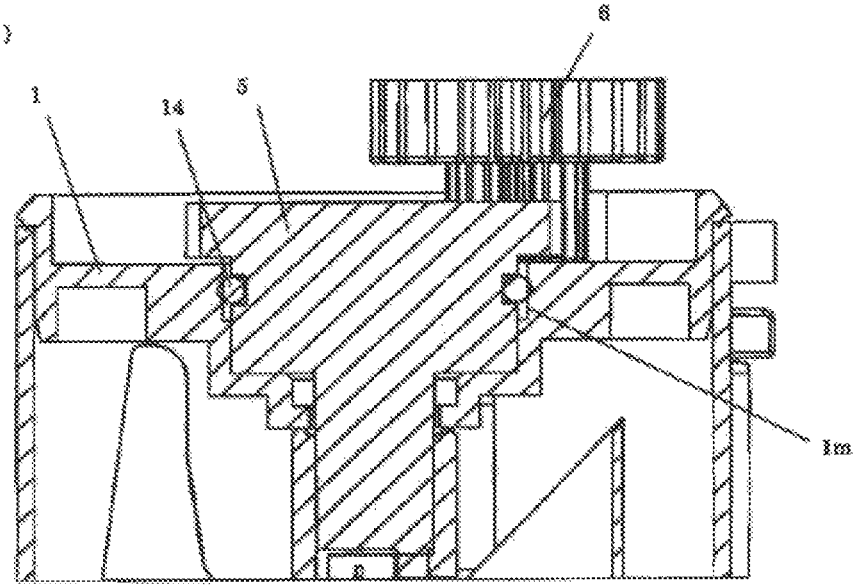

Further, a torque generating mechanism, such as the one shown in FIGS. 25(*a*) and 25(*b*), which gradually reduces the rotational load of the drive transmitting means as driving force is continuously inputted, may be employed.

More concretely, the torque generating mechanism is provided with the ring 14 as a suppressing means, which is placed, in the compressed state, between the peripheral surface 5*a* of the first gear 5 and one of the lengthwise end walls 1*m* of the container body 1*a*. Further, the ring 14 is locked to the peripheral surface 5*a* of the first gear 5. In this embodiment, the ring 14 is formed of a substance which is substantially stronger than the substance used as the material of the ring 14 in the first embodiment. The rotational load is generated by the friction which occurs as the lengthwise end wall 1*m* of the container body 1*a* and compressed ring 14 slide against each other.

Therefore, until the ring 14 deteriorates, the developer supply container 1 is automatically rotated, as in the first embodiment, as driving force is inputted into the driving gear member 12.

The ring 14 is designed so that as it is continuously subjected to friction, it gradually reduces in resiliency. Thus, as driving force is continuously inputted into the driving gear member 12 even after the completion of the automatic rotation of the developer supply container 1, the ring 14 gradually reduces in resiliency, reducing thereby the amount of rotational load it can create, during the very early stage of the developer supplying process, which is carried out after the completion of the automatic rotation of the developer supply container 1.

In this embodiment, the reduction in the friction between the ring 14 and counterpart is used to control the amount of the rotational load. Therefore, the structural arrangement in the first embodiment is preferable.

Embodiment 6

Figure 24:
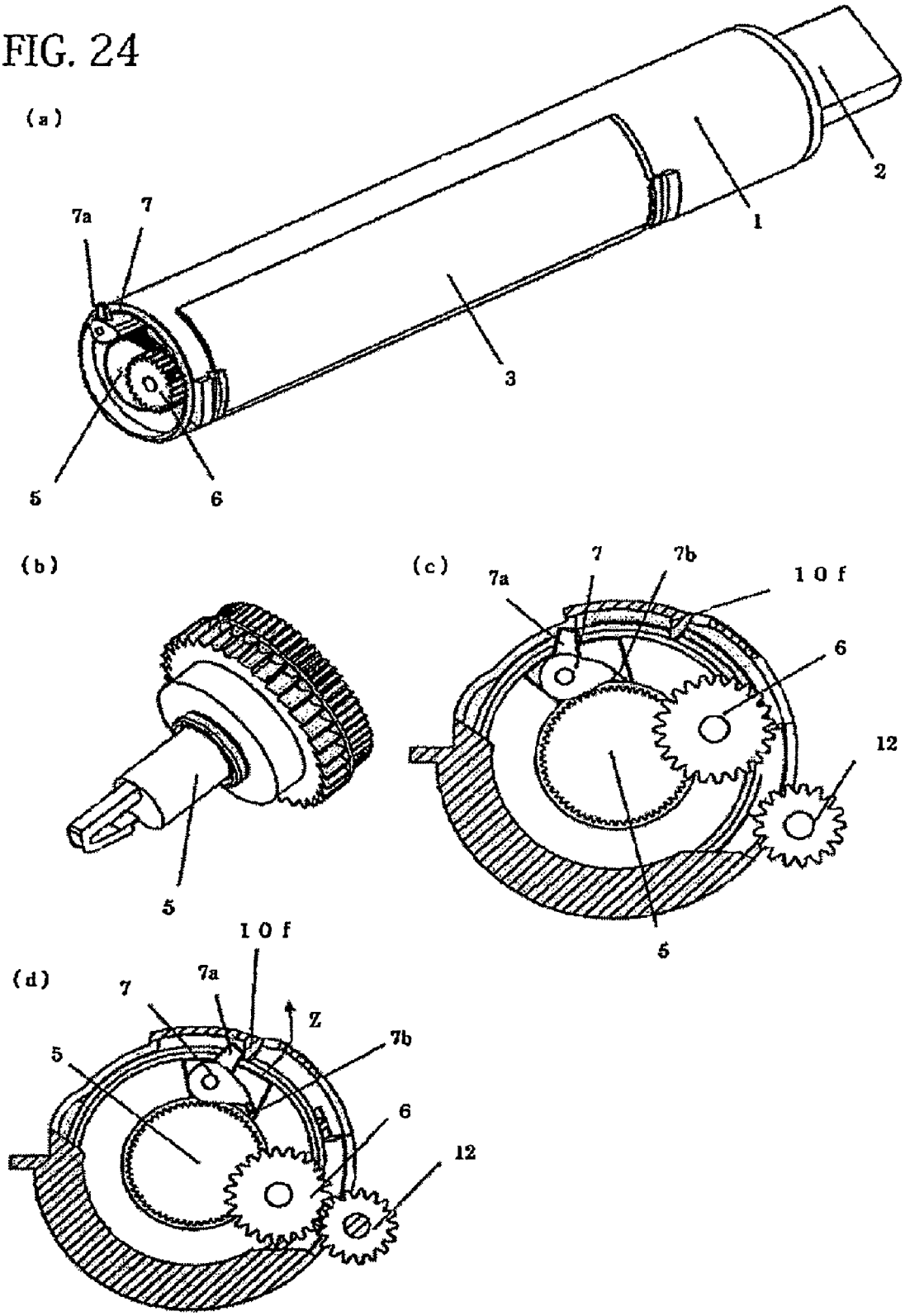
FIG. 24 is a perspective view (a) of a developer supply container according to the present invention, a perspective view (b) of a stirring gear called locking member, a sectional side view (c) illustrating a locking state, and a sectional side view (d) illustrating an unlocking state.

Referring to FIG. 24, a developer supply container 1 according to embodiment 6 will be described. The structure of the container of this embodiment is fundamentally the same as that of embodiment 1, and therefore, the description will be made as to the structure different from that of embodiment 1. The same reference numerals are assigned to the elements having the corresponding functions.

This embodiment is different from the first embodiment in that in this embodiment, the first gear 5 is completely locked to the container body 1*a*. In this embodiment, therefore, the second gear 6 is prevented by the first gear 5, from rotating relative to the container body 1*a*.

More concretely, referring to FIG. 24(*b*), the first gear 5 is an integral part of the locking member 9 as the suppressing member, and there is no ring 14. Further, the disengaging projection 10*f* for disengaging the locking means belongs to the developer receiving device 10.

In this embodiment, as the second gear 6 receives driving force from the driving gear member 12 of the developer receiving device 10, such a force that acts in the direction to pull in the container body 1*a*, because the second gear 6 is prevented from rotating relative to the container body 1*a*, by the locking member 7, as the suppressing means, through the first gear 5. Thus, the container body 1*a* automatically rotates as in the first embodiment. As a result, as the same time as the developer discharge opening 1*b* becomes connected to the developer receiving opening 10*b*, the disengaging portion 7*b* of the locking member 7 comes into contact with the disengaging projection 10*f* of the developer receiving device 10, and is pushed up in the direction indicated by the arrow mark Z by the disengaging projection 10*f*. Therefore, the first gear 5 is unlocked.

In this embodiment, the first gear 5 and locking member 9 in the first embodiment are integrated, and the engaging portion 7*b* of the locking member 7 is caught by the locking member 9. In principle, the point at which the driving force transmitting means is locked may be any point of the stirring system. For example, it may be locked at one of the teeth of the first gear 5, or one of the teeth of the second gear 6.

In the first embodiment, the portion which provides the container body 1*a* with rotational force while the container body 1*a* is pulled in, is the shaft by which the second gear 6 is supported as described before. Thus, the greater the distance between this shaft and the rotational axis of the container body 1*a*, the easier the container body 1*a* rotates, and accordingly, the smaller the value to which the rotational load for the second gear 6 can be set. In a case in which the first gear 5 is regulated in terms of its rotation relative to the developer supply container 1 as in this embodiment, the greater the distance between the member for deregulating the first gear 5 and the rotational axis of the container body 1*a*, the smaller the amount of load to which the deregulating member is subjected, and therefore, the smaller the amount of force necessary to be applied to the deregulating member to deregulate the first gear 5.

In this embodiment, a component, such as the ring 14 employed in the first embodiment, is unnecessary, making it possible to reduce the cost of the developer supply container 1.

However, in this embodiment, it is possible that the timing which with the developer discharge opening 1*b* becomes connected to the developer receiving opening 10*b* deviates from the timing with which the unlocking timing, because of the nonuniformity in the measurements and positioning of the various members of the developer supply container 1 and developer receiving device 10. Therefore, the structural arrangement in the first embodiment, which has no possibility of the occurrence of such a problem, is preferable.

Embodiment 7

Figure 26:
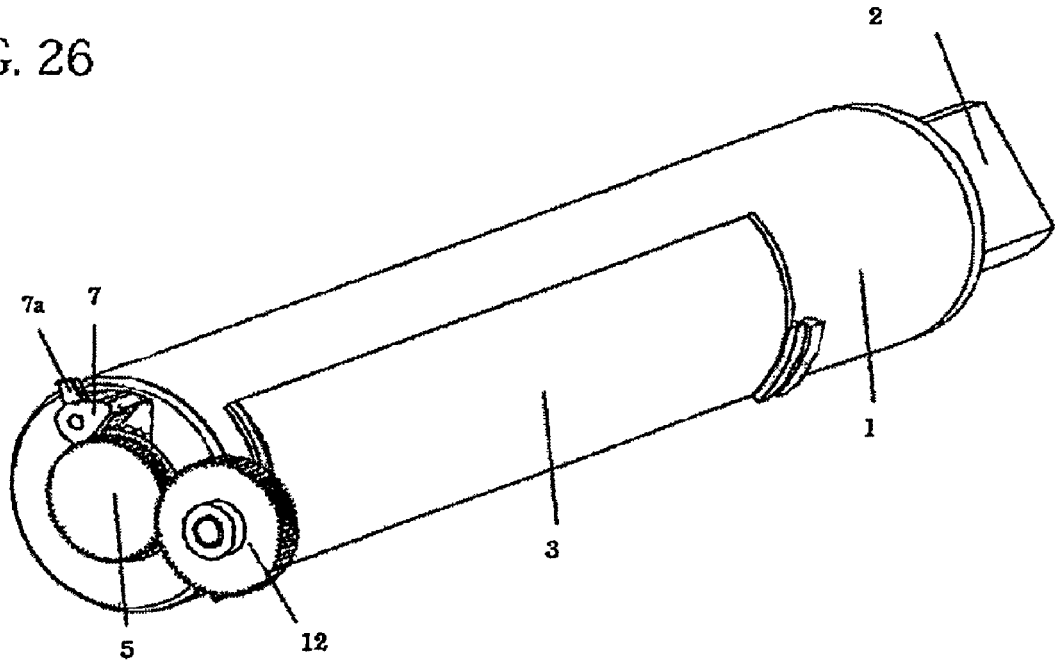
FIG. 26 is a perspective view of a developer supply container according to the present invention.

Referring to FIG. 26, a developer supply container 1 according to embodiment 7 will be described. The structure of the container of this embodiment is fundamentally the same as that of embodiment 1, and therefore, the description will be made as to the structure different from that of embodiment 1. The same reference numerals are assigned to the elements having the corresponding functions.

In this embodiment, the drive transmitting means is not provided with the second and third gears; it is provided with only the first gear 5. Further, the first gear 5 is an integral part of the locking member 9, and there is no ring 14. The first gear 5 is completely locked so that it cannot rotate relative to the container body 1*a*.

In this embodiment, the first gear 5 engages with the driving gear member 12 of the developer receiving device 10 at the end of the process of mounting the developer supply container 1 into the developer receiving device 10. At this point in time, driving force is inputted into the driving gear member 12. As the driving force is inputted, rotational force is generated in the container body 1*a*, because the first gear 5 is locked to the container body 1*a* by the locking claw 7 as the suppressing means.

Therefore, the container body 1*a* automatically rotates as in the first embodiment. As a result, the developer discharge opening 1*b* becomes aligned with the developer receiving opening 10*b*, and at the same time, the disengaging portion 7*b* of the locking member 7 collides with the disengagement projection 10*a* of the developer receiving device 10, being thereby pushed up in the direction indicated by the arrow mark Z. Therefore, the first gear 5 is unlocked form the container body 1*a*.

Further, in this embodiment, the first gear 5 and locking member 9 which are employed in the first embodiment are integrated into a single component, and the locking portion 7*b* of the locking member 7 is caught by this component, more specifically, the locking portion (9) of this component. In principle, however, the point at which the driving force transmitting means is locked may be any point in the stirring system. For example, it may be locked at one of the teeth of the first gear 5.

Further, while the driving force transmitting means remains locked in this embodiment, the first gear 5 remains regulated in terms of its rotation relative to the container body 1*a*. This regulation may be such that if the amount of torque applied to the first gear 5 in the direction to rotate the first gear 5 relative to the container body 1*a* is greater than a certain value, the first gear 5 rotates relative to the container body 1*a*. For example, the first gear 5 may be attached to the container body 1*a*, with a member such as the ring 14 employed in the first embodiment placed between the container body 1*a* and first gear 5.

In the first embodiment, the portion which provides the container body 1*a* with rotational force while the developer supply container is pulled in, as described above, is the shaft with which the second gear 6 is supported, and the greater the distance between this shaft and the rotational axis of the container body 1*a*, the easier to rotate the container body 1*a*, and therefore, the smaller the amount of the rotational load which the second gear 6 is required to have. However, in the case of a structural arrangement such as the one in this embodiment, in which the second gear 6 is not present, the greater the distance between the rotational axis of the container body 1*a* and a regulating-deregulating member for regulating or deregulating the rotation of the first gear 5 relative to the container body 1*a*, the smaller the load to which the regulating-deregulating portion of the regulating-deregulating member is subjected, and therefore, the smaller the mechanical strength of which the regulating-deregulating portion is required.

In this embodiment, all the processes for rotating the developer supply container 1 after the mounting of the developer supply container 1 are automatically carried out. Therefore, this embodiment is superior in usability to the first embodiment. Further, this embodiment does not employ the ring 14, making it possible to reduce the cost of the developer supply container 1.

However, in this embodiment, it is possible that the timing which with the developer discharge opening 1*b* becomes connected to the developer receiving opening 10*b* will deviate from the timing with which the unlocking timing, because of the nonuniformity in the measurements and positioning of the various members of the developer supply container 1 and developer receiving device 10. Also in this embodiment, when the developer supply container 1 is inserted into the developer receiving device 10, the first gear 5 comes into contact with the driving gear member 12 from the direction parallel to the axial lines of the two gears (first gear 5 and driving gear member 12). Therefore, it is possible that the misalignment of teeth between the two gears will make it difficult to fully insert the developer supply container 1. Therefore, the structural arrangement in the first embodiment, which has no possibility of the occurrence of such a problem, is preferable.

In this embodiment, the first gear 5 is kept completely locked. However, the developer supply container 1 may be structured so that the first gear 5 is rotatable as long as the rotational force applied to the first gear 5 is greater than a preset value. In such a case, the locking member 7 is disengaged from the locking member 9 by the disengaging projection of the locking member 9 which rotates with the first gear 5 relative to the container body 1, after the completion of the automatic rotation of the developer supply container 1. Therefore, the developer discharge opening 1*b* can be properly connected with the developer receiving opening 10*b*.

Embodiment 8

Figure 27:
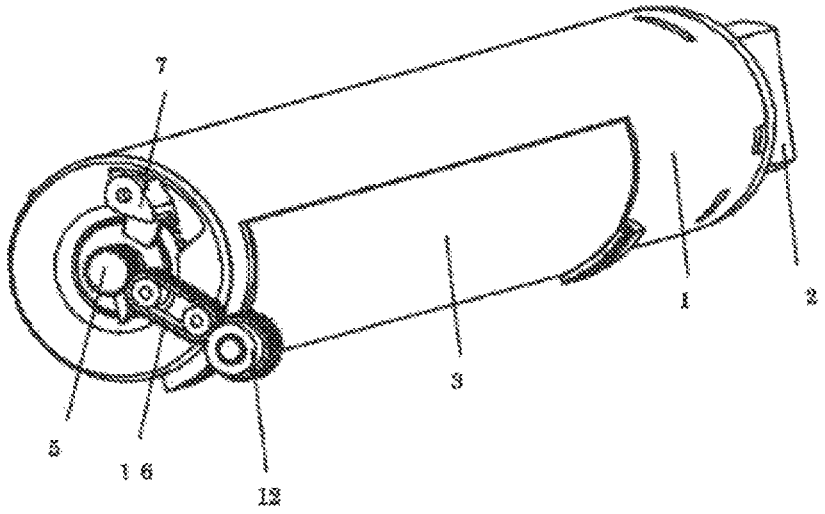
FIG. 27 is a perspective view of a developer supply container according to the present invention.
Figure 28:
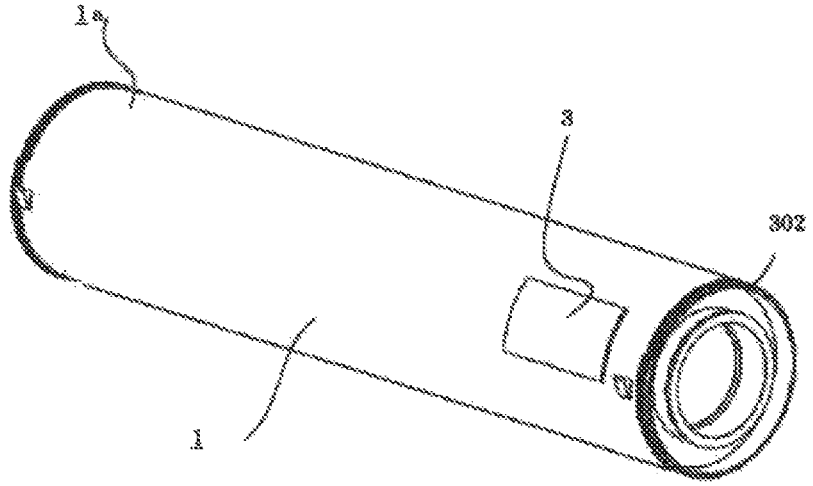
FIG. 28 is a perspective view of a developer supply container according to the present invention.
Figure 29:
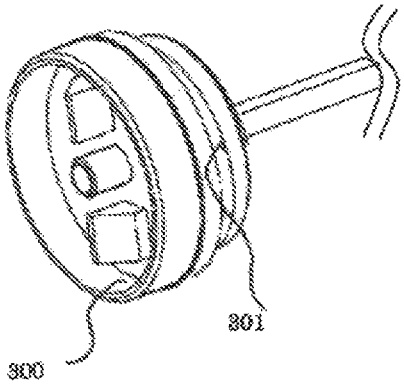
FIG. 29 is a perspective view of a coupling member for the developer supply container.

Referring to FIG. 27, a developer supply container 1 according to embodiment 8 will be described. The structure of the container of this embodiment is fundamentally the same as that of embodiment 1, and therefore, the description will be made as to the structure different from that of embodiment 1. The same reference numerals are assigned to the elements having the corresponding functions.

In this embodiment, the drive transmitting means is made up of the first gear 5, a driving force transmitting belt 16, and two pulleys by which the belt 16 is suspended. Referring to FIG. 24(*b*), also in this embodiment, the first gear 5 and locking member 9 are integrated, and the ring 14 is not present. The first gear 5 is completely locked to the container body 1*a* by the locking portion (9), being prevented from rotating relative to the container body 1*a*.

In this embodiment, in order to prevent the driving force transmitting belt 16 from rotating relative to the pulleys, the inward surface of the driving force transmitting belt 16 and the peripheral surface of each pulley have been rendered highly frictional. Incidentally, both the inward surface of the driving force transmitting belt 16, and the peripheral surface of each pulley, may be toothed to provide a higher level of insurance that the belt 16 and pulleys do not slip relative to each other.

In this embodiment, the toothed portion of the driving force transmitting belt 16 engages with the driving gear member 12 of the developer receiving device 10 at the end of the operation in which the developer supply container 1 is rotated by the preset angle by a user after the mounting of the developer supply container 1 into the developer receiving device 10. Thereafter, the cover for mounting or dismounting the developer supply container 1 is closed, and driving force is inputted into the driving gear member 12. As the driving force is inputted into the driving gear member 12, the rotational force is generated in the developer supply container 1, because the first gear 5 remains locked to the container body 1*a* by the locking member 7 as the suppressing means.

Therefore, the container body 1*a* automatically rotates as in the first embodiment. As a result, the developer discharge opening 1*b* becomes aligned with the developer receiving opening 10*b*, and at the same time, the disengaging portion 7*b* of the locking member 7 collides with the disengagement projection 10*a* of the developer receiving device 10, being thereby pushed up in the direction indicated by the arrow mark B. Therefore, the first gear 5 is unlocked form the container body 1*a*.

The structural arrangement in this embodiment is advantageous over the structural arrangement employed in the first embodiment in that it affords more latitude (positional latitude) in designing the drive transmitting means.

However, there is the possibility that the timing which with the developer discharge opening 1*b* becomes connected to the developer receiving opening 10*b* will deviate from the timing with which the unlocking timing, because of the nonuniformity in the measurements and positioning of the various members of the developer supply container 1 and developer receiving device 10. Therefore, the structural arrangement in the first embodiment, which has no possibility of the occurrence of such a problem, is preferable.

Incidentally, the first gear 5 is kept completely locked. However, the developer supply container 1 may be structured so that the first gear 5 is provided with a certain amount of rotational load instead of being completely locked. In such a case, the locking member 7 is freed from the locking member 9 by the disengaging projection of the locking member 9 which rotates with the first gear 5 relative to the container body 1, after the completion of the automatic rotation of the developer supply container 1. Therefore, the developer discharge opening 1*b* can be properly connected with the developer receiving opening 10*b*.

Embodiment 9

Referring to FIG. 28-FIG. 31, the developer supply container 1 the Embodiment 9 will be described.

The structure of the container of this example is fundamentally the same as with Embodiment 1, and therefore, the description will be made only as to the structure different from Embodiment 1. The same reference numerals are assigned to the corresponding elements.

Figure 30:
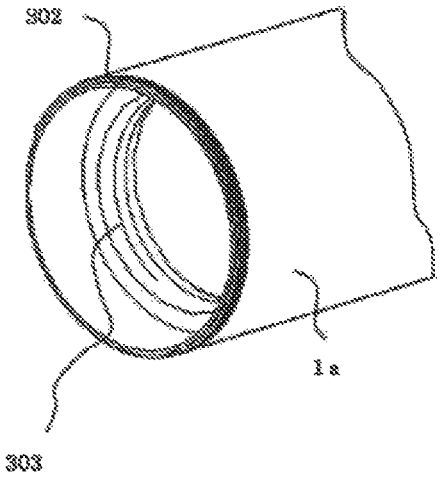
FIG. 30 is a perspective view of the developer supply container of FIG. 30 as seen from a flange portion.

As shown in FIG. 30, in this example, the drive transmitting means for the developer supply container comprises a coupling member 300. The coupling member 300 is integrally molded with a shaft portion of the feeding member.

And, on the coupling member 300, a helical screw portion 301 (FIG. 29) is formed as suppressing means (rotation load increasing means). Correspondingly thereto, a flange portion 302 fixed to the longitudinal end of the container body is provided with a helical screw portion 303 (FIG. 30) as suppressing means (rotation load increasing means). The screw portions function also as switching means for switching the rotation load applied on the drive transmitting means.

During assembling the developer supply container 1, they are fastened by screw portion to prevent rotation of the coupling member 300 relative to the container body. The fastening force by the screw portion is adjusted when they are assembled.

When the user mounts the developer supply container 1 in which the coupling member 300 and the container body are fastened with each other to the developer receiving apparatus 10, the coupling member 300 of the developer supply container 1 is brought into engagement with the coupling member 304 of the developer receiving apparatus 10.

Figure 31:
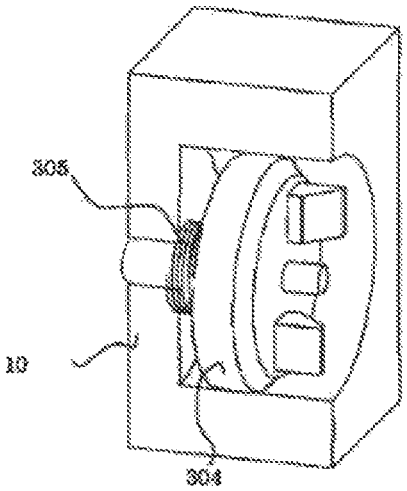
FIG. 31 is a perspective view of a coupling portion provided in the developer reception side, wherein (a) illustrates a state where coupling phases are not aligned, and (b) illustrates a state where they are aligned.
Figure 31:
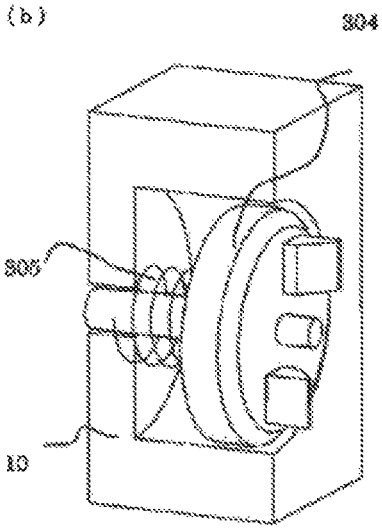

The coupling member 304 of the developer receiving apparatus, as shown in FIG. 31, is urged by the spring 305 toward the developer supply container. Therefore, in case that coupling phases between the coupling members are not matched, the coupling member 304 of the developer receiving apparatus retracts (FIG. 31, (*a*)), and the coupling member 304 rotates to eventually establish the driving connection therebetween.

The exchange cover is closed by the user, and then the rotational driving force is inputted to the coupling member 304 of the developer receiving apparatus 10, by which the developer supply container 1 rotates automatically from the mounting and demounting position toward the operating position (supply position). This is because the coupling member 300 of the developer supply container is fastened to the container body by the screw portion, and the developer supply container and the coupling member 300 are unified in effect, as described hereinbefore. At this time, the unsealing movements of the container shutter and the developing device shutter are carried out in interrelation with each other, and therefore, the developer discharge opening and the developer receiving opening are brought into communication with each other.

The developer supply container placed at the operating position, similarly to the Embodiment 1, is prevented from a further rotation. In this state, the drive from the developer receiving apparatus 10 to the coupling member 304 continues to input, the fastening force between the screw portion 301 of the coupling member 300 and the screw portion 303 of the container body side reduces, and sooner or later, a relative rotation starts between the coupling member 300 and the container.

Therefore, similarly to the Embodiment 1, the force required for rotation of the coupling member 300 in the subsequent developer supply step can be reduced also in this example.

The fastening force by the screw portions in this example is preferably large from the standpoint of accomplishment of the automatic rotation of the developer supply container. However, it is preferable that fastening state of the screw portions is released as soon as the automatic rotation of the developer supply container is effected. Therefore, the fastening force of the screw portions is set in view of these factors.

On the other hand, when the image forming apparatus discriminates that developer remainder in the developer supply container is so small that container should be exchanged, the coupling member 304 of the developer receiving apparatus is supplied with a rotational driving force in the direction opposite to that at the time of the setting operation.

This rotates the coupling member 300 of the developer supply container in the direction opposite to that at the time of setting operation (supply operation), sooner or later, the screw portion 301 is induced into the screw portion 303 of the flange portion 302 so that it is fastened. As a result, by the rotational driving force received by the coupling member 300 in the fastening relation by the screw portions, the developer supply container automatically rotates from the operating position to the mounting and demounting position.

Similarly to the Embodiment 1, the resealing movements of the container shutter and the developing device shutter are effected in interrelation with each other, the developer discharge opening and the developer receiving opening are resealed.

At this time, the image forming apparatus stops the drive supply to the coupling member of the developer receiving apparatus, and outputs a message promoting exchange of the developer supply container to the liquid crystal operating portion.

The user opens the exchange cover in response to the message, whereby the used-up developer supply container can be taken out, and therefore, a new developer supply container can be mounted.

The structure of this embodiment is better than the structure of Embodiment 1 in that operation by the user is less. This example uses a fastening force of the screw portions, and in view of composability of the automatic rotation of the developer supply container and the drive of the feeding member, the structure of Embodiment 1 is further preferable.

In this example, the screw portion is provided on the shaft portion (the shaft portion of the feeding member, too) of the coupling member 300, but the above-described screw portion may be provided on the shaft portion at the other end away from the coupling member 300 of the feeding member. In such a case, the flange portion fixed to the other end of the container is provided with a screw portion similar to the above-described screw portion, correspondingly to the screw portion provided at the other end of the feeding member.

As described in the foregoing, in Embodiments 1-9, the container body 1*a* is automatically rotated using the drive transmitting means, but the following is a possible alternative.

For example, a dual cylinder structure constituted by an inner cylinder containing the developer and an outer cylinder rotatable around the inner cylinder can be employed.

In such a case, the inner cylinder is provided with an opening for permitting discharging of the developer, and the outer cylinder is also provided with an opening (developer discharge opening) for permitting discharging of the developer. The openings of the inner cylinder and the outer cylinder are not in communication with each other before the developer supply container is mounted, the outer cylinder functions as the above-described container shutter 3.

The opening of the outer cylinder is sealed by such sealing film as described hereinbefore. The sealing film is peeled off by the user prior to rotation of the developer supply container after the developer supply container is mounted to the developer receiving apparatus.

In order to prevent leakage of the developer into between the inner cylinder and the outer cylinder, an elastic sealing member is provided around the opening of the inner cylinder, and the elastic sealing member is compressed by the inner cylinder and the outer cylinder to a predetermined extent.

At this time when such a developer supply container is mounted to the developer receiving apparatus, the opening of the inner cylinder is opposed to the developer receiving opening of the developer receiving apparatus, and on the other hand, the opening of the outer cylinder is not opposed to the developer receiving opening but faces upward substantially.

Similarly to the above-described embodiments, the developer supply container is set in this state, by which only the outer cylinder is rotatable relative to the inner cylinder locked on the developer receiving apparatus non-rotatably.

As a result, in interrelation with the rotation of the developer supply container to the operating position (supply position), the unsealing operation of the developing device shutter is effected, and further the opening of the outer cylinder is opposed to the developer receiving opening, and therefore, the opening of the inner cylinder, the opening of the outer cylinder and the developer receiving opening are communicated eventually.

As for a dismounting operation for the developer supply container, similarly to the above-described embodiments, the outer cylinder is rotated in the direction opposite to that at this time of the setting operation, by which the opening of the inner cylinder and the developer receiving opening are resealed interrelatedly. The opening of the outer cylinder is kept open, but the amount of scattering of the developer is very small since, at the time of taking the developer supply container out of the apparatus, point the opening of the inner cylinder is resealed by the outer cylinder, and since the opening of the outer cylinder face up.

In the foregoing, the examples of the developer supply container according to the present invention have been described with Embodiments 1-9, but the structures of Embodiments 1-9 may be properly combined or replaced within the spirit of the present invention.

INDUSTRIAL APPLICABILITY

According to the present invention, an operability of the developer supply container can be improved. A structure for improving the operability of the developer supply container can be simplified.

The invention claimed is:

1. A developer accommodation device comprising:

a developer accommodating portion including a cylindrical portion and configured to accommodate a developer;

a stirring member, including a rotation shaft and a stirring portion configured to stir the developer, rotatable about an axis of said rotation shaft to stir the developer in said developer accommodating portion;

a drive transmission member provided at one side of said developer accommodating portion and configured to transmit a rotational force to said stirring member;

an engaging portion provided at one end portion, with respect to a rotational axis direction of said rotation shaft, of said rotation shaft and engaged with said drive transmission member;

a holding portion provided at said rotation shaft and configured to hold said stirring portion;

a hole portion rotatably supporting the other end portion of said rotation shaft, wherein said hole portion has an outer diameter smaller than an outer diameter in a cross-section of a central portion, with respect to the rotational axis direction, of said rotational shaft, and wherein said cylindrical portion is provided with a discharge opening configured to discharge the developer, the discharge opening extending across the central portion in the rotational axis direction.

* * * * *